US010787988B2

(12) United States Patent
Fujita et al.

(10) Patent No.: US 10,787,988 B2
(45) Date of Patent: Sep. 29, 2020

(54) INTERNAL COMBUSTION ENGINE

(71) Applicant: NICHIAS CORPORATION, Tokyo (JP)

(72) Inventors: Yoshifumi Fujita, Tokyo (JP); Tatsunori Kataoka, Tokyo (JP); Shin Shigeuchi, Osaka (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 16/486,561

(22) PCT Filed: Feb. 13, 2018

(86) PCT No.: PCT/JP2018/004883
§ 371 (c)(1),
(2) Date: Aug. 16, 2019

(87) PCT Pub. No.: WO2018/151094
PCT Pub. Date: Aug. 23, 2018

(65) Prior Publication Data

US 2019/0360427 A1 Nov. 28, 2019

(30) Foreign Application Priority Data

Feb. 17, 2017 (JP) ..... 2017-028006

(51) Int. Cl.
*F02F 1/16* (2006.01)
*F02F 1/14* (2006.01)
(Continued)

(52) U.S. Cl.
CPC ..... *F02F 1/163* (2013.01); *F01P 3/02* (2013.01); *F02F 1/004* (2013.01); *F02F 1/14* (2013.01);
(Continued)

(58) Field of Classification Search
CPC ..... F02F 1/163; F02F 2001/104; F02F 1/16; F02F 1/004; F01P 3/02; F01P 2003/001; F01P 2003/021
See application file for complete search history.

(56) References Cited

U.S. PATENT DOCUMENTS

2003/0230253 A1* 12/2003 Matsutani ..... F01P 9/00 123/41.74
2013/0160725 A1* 6/2013 Nishio ..... F02F 1/10 123/41.79
(Continued)

FOREIGN PATENT DOCUMENTS

JP 2008-031939 2/2008
JP 2015-113770 6/2015
(Continued)

OTHER PUBLICATIONS

International Search Report for PCT/JP2018/004883, dated Apr. 17, 2018, 4 pages.
(Continued)

*Primary Examiner* — Jacob M Amick
(74) *Attorney, Agent, or Firm* — Nixon & Vanderhye P.C.

(57) ABSTRACT

A heat retention material cartridge fixed to a base member of a heat retention tool of a cylinder bore's bore wall for heat retention of the cylinder bore wall, which includes a thermosensitive expansion rubber, a back-side pressing member, a rectangular opening, a front-side abutting plate cooperative with the back-side pressing member for sandwiching an outer edge portion of the thermosensitive expansion rubber, and an elastic member attached member to which an elastic member is attached. A convex portion being convex toward the side of the back-side pressing member is formed in a portion of the front-side abutting plate where the outer end is not sandwiched by bendable portions. And, the outer edge portion of the thermosensitive expansion rubber is formed in
(Continued)

such a manner that the outer end of the thermosensitive expansion rubber is positioned inside an apex of the convex portion.

2 Claims, 17 Drawing Sheets

(51) Int. Cl.

| | |
|---|---|
| ***F01P 3/02*** | (2006.01) |
| ***F02F 1/00*** | (2006.01) |
| *F01P 3/00* | (2006.01) |
| *F02F 1/10* | (2006.01) |

(52) U.S. Cl.
CPC ... *F01P 2003/001* (2013.01); *F01P 2003/021* (2013.01); *F02F 2001/104* (2013.01)

(56) References Cited

U.S. PATENT DOCUMENTS

| | | | | |
|---|---|---|---|---|
| 2016/0017838 | A1* | 1/2016 | Nishio | F02F 1/14 123/193.2 |
| 2017/0030289 | A1* | 2/2017 | Okawa | F02F 1/14 |
| 2017/0045012 | A1* | 2/2017 | Okawa | F02F 1/14 |
| 2018/0363587 | A1* | 12/2018 | Yoshimura | F01P 3/02 |

FOREIGN PATENT DOCUMENTS

| | | |
|---|---|---|
| JP | 2015-200303 | 11/2015 |
| JP | 2016-156277 | 9/2016 |

OTHER PUBLICATIONS

Office Action issued in KR Appln. No.10- 2019-7024192 dated Jul 23, 2020 (w/ translation)—6 pgs.

* cited by examiner (X-X) (Y-Y)

(A)

(B)

(X-X) (Y-Y)

(A)

(B)

INTERNAL COMBUSTION ENGINE

This application is the U.S. national phase of International Application No. PCT/JP2018/004883 filed 13 Feb. 2018, which designated the U.S. and claims priority to JP Patent Application No. 2017-028006 filed 17 Feb. 2017, the entire contents of each of which are hereby incorporated by reference.

TECHNICAL FIELD

The present invention relates to a heat retention material cartridge used as a heat retention material for a heat retention tool disposed in contact with groove-like cooling water passage-side wall surfaces of cylinder bore walls of a cylinder block of an internal combustion engine, and also relates to a cylinder bore wall heat retention tool including the same, and an internal combustion engine and an automotive vehicle provided with the them.

BACKGROUND ART

In the internal combustion engine, because of its structure causing fuel to explode at the top dead center of a piston in the bore and pushing down the piston by the explosion, the upper side of each cylinder bore wall has a higher temperature and the lower side has a lower temperature. Therefore, a difference arises in thermal deformation amount between the upper and lower sides of the cylinder bore wall. The upper side expands largely while the expansion of the lower side is smaller.

As a result, the frictional resistance between the piston and the cylinder bore wall increases, and this becomes a factor degrading fuel consumption. Therefore, it is required to reduce the difference in thermal deformation amount between the upper and lower sides of the cylinder bore wall.

Therefore, to make wall temperatures of respective cylinder bore walls uniform, it has been attempted to control the cooling efficiency by the cooling water on the upper and lower sides of the cylinder bore wall by installing a spacer in a groove-like cooling water passage to adjust the flow of cooling water in the groove-like cooling water passage. For example, Patent Literature 1 discloses an internal combustion engine cooling heat-transfer medium passage partition member, which is a passage partition member for partitioning a groove-like cooling heat-transfer medium passage into a plurality of passages when disposed in the groove-like cooling heat-transfer medium passage formed in a cylinder block of an internal combustion engine, including a passage division member formed to have a height not reaching the depth of the groove-like cooling heat-transfer medium passage and serving as a wall portion for dividing the groove-like cooling heat-transfer medium passage into a bore-side passage and an anti-bore-side passage, and a flexible lip member formed from the passage division member in a direction toward an opening portion of the groove-like cooling heat-transfer medium passage, and having a tip edge portion formed of a flexible material so as to extend beyond one inner surface of the groove-like cooling heat-transfer medium passage, so that the tip edge portion comes into contact with the inner surface by its own deflection restoration force, at an intermediate position in the depth direction of the groove-like cooling heat-transfer medium passage after completion of the insertion into the groove-like cooling heat-transfer medium passage, for separation into the bore-side passage and the anti-bore-side passage.

However, according to internal combustion engine cooling heat-transfer medium passage partition member disclosed in Patent Literature 1, since wall temperatures of cylinder bore walls can be made uniform to some extent, the difference in the thermal deformation amount between the upper and lower sides of the cylinder bore wall can be reduced. However, in recent years, it is required to further reduce the difference in the thermal deformation amount between the upper and lower sides of the cylinder bore wall.

Therefore, in recent years, wall temperatures of cylinder bore walls are made uniform by using a heat retention tool for active heat retention of a cylinder bore-side wall surface in a middle lower region of the groove-like cooling water passage of a cylinder block. Further, to attain effective heat retention of the cylinder bore-side wall surface in the middle lower region of the groove-like cooling water passage, the adhesion of the heat retention tool to the cylinder bore-side wall surface in the middle lower region of the groove-like cooling water passage is required to be high.

CITATION LIST

Patent Literature

[Patent Literature 1]
Japanese Patent Laid-Open No. 2008-31939 (Claims)

SUMMARY OF INVENTION

Technical Problem

From such background, the applicant has developed a cylinder bore wall heat retention tool that is a heat retention tool installed in a groove-like cooling water passage of a cylinder block of an internal combustion engine having cylinder bores for heat retention of bore walls of one side half or a part of the one side of bore walls of all the cylinder bores, including a heat retention portion being arc-shaped when viewed from above for heat retention of a cylinder bore-side wall surface of the groove-like cooling water passage, and a support portion having a shape along the shape of the groove-like cooling water passage at an installation position of the heat retention tool for fixing the heat retention portion, wherein the heat retention portion includes a rubber member coming into contact with the cylinder bore-side wall surface of the groove-like cooling water passage and covering the cylinder bore-side wall surface of the groove-like cooling water passage, a back-side pressing member provided on the back side of the rubber member for pressing the rubber member entirely from the back side toward the cylinder bore-side wall surface of the groove-like cooling water passage, and an elastic member for urging toward the cylinder bore-side wall surface of the groove-like cooling water passage so that the back-side pressing member presses the rubber member, wherein the heat retention portion is fixed to the support portion only at or near the center in the circular arc direction, and previously filed applications (Japanese Patent Application No. 2015-221931 and Japanese Patent Application No. 2015-221932).

In the cylinder bore wall heat retention tool according to these patent applications, used as a heat retention material is the heat retention portion (heat retention material cartridge) having the rubber member coming into contact with the cylinder bore-side wall surface of the groove-like cooling water passage and covering the cylinder bore-side wall surface of the groove-like cooling water passage, the back-side pressing member provided on the back side of the rubber member for pressing the rubber member entirely from the back side toward the cylinder bore-side wall surface of the groove-like cooling water passage, and the elastic member for urging toward the cylinder bore-side wall surface of the groove-like cooling water passage so that the back-side pressing member presses the rubber member.

FIG. 27 illustrates an example of the heat retention portion. In FIG. 27, a heat retention portion 55 includes a rubber member 51, a back-side pressing member (not illustrated) provided on the back side of the rubber member for pressing the rubber member 51 entirely from the back side toward a cylinder bore wall surface of a groove-like cooling water passage, a front-side abutting plate 50 provided on the contact surface side of the rubber member 51 and having a rectangular opening, and an elastic member (not illustrated) for urging toward the cylinder bore-side wall surface of the groove-like cooling water passage so that the back-side pressing member presses the rubber member 51. In the heat retention portion 55, bendable portions 531*a* formed at an upper end of an elastic member attached member (not illustrated) to which the elastic member is attached, bendable portions 531*b* formed at a lower end thereof, a bendable portion 532*a* formed at a right end thereof, and a bendable portion 532*b* formed at a left end thereof are bent toward the front-side abutting plate 50, so that the back-side pressing member, the rubber member 51, and the front-side abutting plate 50 are sandwiched between the bendable portions and the elastic member attached member.

There is no problem if the rubber member of the heat retention portion 55 is solid rubber or the like. However, in the case of using a rubber material such as a thermosensitive expansion rubber that largely expands in the groove-like cooling water passage, if the thermosensitive expansion rubber expands when installed and heated in the groove-like cooling water passage, the expanded thermosensitive expansion rubber may protrude from an upper or lower side of the heat retention portion 55 and then the flow of cooling water may break off the thermosensitive expansion rubber at the protrusion portion.

Accordingly, the present invention intends to provide a heat retention material cartridge capable of preventing the expanded thermosensitive expansion rubber from protruding from the upper or lower side of the heat retention material cartridge even when it thermo-sensitively expands in the groove-like cooling water passage, in the case of using the thermosensitive expansion rubber as the rubber member of the heat retention material cartridge.

Solution to Problem

The above-mentioned problem can be solved by the present invention described below. That is, present invention (1) is a heat retention material cartridge fixed to a base member of a heat retention tool of a cylinder bore's bore wall for heat retention of the cylinder bore wall, which includes a thermosensitive expansion rubber coming into contact with a cylinder bore-side wall surface of a groove-like cooling water passage and covering the cylinder bore-side wall surface of the groove-like cooling water passage, a back-side pressing member being arc-shaped when viewed from above, and provided on a back side of the thermosensitive expansion rubber for pressing the thermosensitive expansion rubber entirely from the back side toward the cylinder bore-side wall surface of the groove-like cooling water passage, a front-side abutting plate provided on a contact surface of the thermosensitive expansion rubber, having an arc-shaped when viewed from above and having an rectangular opening when viewed from the front side, and cooperative with the back-side pressing member for sandwiching an outer edge portion of the thermosensitive expansion rubber, and an elastic member attached member to which an elastic member is attached, being arc-shaped when viewed from above, and provided on a back side of the back-side pressing member for urging toward the cylinder bore-side wall surface of the groove-like cooling water passage so that the back-side pressing member presses the thermosensitive expansion rubber, wherein bendable portions are formed at an upper end, a lower end, a right end, and a left end of the elastic member attached member, and the bendable portions are bent toward the front-side abutting plate, so that the back-side pressing member, the thermosensitive expansion rubber, and the front-side abutting plate are sandwiched between the bendable portions and the elastic member attached member, there is a portion where an outer end is not sandwiched by the bendable portions at least at an upper-side portion and a lower-side portion of the front-side abutting plate, a convex portion being convex toward the back-side pressing member and extending in the longitudinal direction of the upper-side portion of the front-side abutting plate is formed in the portion where the outer end is not sandwiched by the bendable portions at the upper-side portion of the front-side abutting plate, and a convex portion being convex toward the back-side pressing member and extending in the longitudinal direction of the lower-side portion of the front-side abutting plate is formed in the portion where the outer end is not sandwiched by the bendable portions at the lower-side portion of the front-side abutting plate, and the outer edge portion of the thermosensitive expansion rubber is formed in such a manner that the outer end of the thermosensitive expansion rubber is positioned inside an apex of the convex portion, at the portion of the front-side abutting plate where the convex portion is formed.

Further, present invention (2) is a heat retention material cartridge fixed to a base member of a heat retention tool of a cylinder bore's bore wall for heat retention of the cylinder bore wall, which includes a thermosensitive expansion rubber coming into contact with a cylinder bore-side wall surface of a groove-like cooling water passage and covering the cylinder bore-side wall surface of the groove-like cooling water passage, a back-side pressing member being arc-shaped when viewed from above, and provided on a back side of the thermosensitive expansion rubber for pressing the thermosensitive expansion rubber entirely from the back side toward the cylinder bore-side wall surface of the groove-like cooling water passage, a front-side abutting plate provided on a contact surface of the thermosensitive expansion rubber, having an arc-shape when viewed from above and having an rectangular opening when viewed from the front side, and cooperative with the back-side pressing member for sandwiching an outer edge portion of the thermosensitive expansion rubber, and an elastic member attached to the back-side pressing member for urging toward the cylinder bore-side wall surface of the groove-like cooling water passage so that the back-side pressing member presses the thermosensitive expansion rubber, wherein bendable portions are formed at an upper end, a lower end, a right end, and a left end of the back side pressing member, and the bendable portions are bent toward the front-side abutting plate, so that the thermosensitive expansion rubber and the front-side abutting plate are sandwiched between the bendable portions and the back-side pressing member, there is a portion where an outer end is not sandwiched by the bendable portions at least at an upper-side portion and a lower-side portion of the front-side abutting plate, a convex portion being convex toward the back-side pressing member and extending in the longitudinal direction of the upper-side portion of the front-side abutting plate is formed in the portion where the outer end is not sandwiched by the bendable portions at the upper-side portion of the front-side abutting plate, and a convex portion being convex toward the back-side pressing member and extending in the longitudinal direction of the lower-side portion of the front-side abutting plate is formed in the portion where the outer end is not sandwiched by the bendable portions at the lower-side portion of the front-side abutting plate, and the outer edge portion of the thermosensitive expansion rubber is formed in such a manner that the outer end of the thermosensitive expansion rubber is positioned inside an apex of the convex portion, at the portion of the front-side abutting plate where the convex portion is formed.

Further, present invention (3) provides a cylinder bore wall heat retention tool that is a heat retention tool installed in a groove-like cooling water passage of a cylinder block of an internal combustion engine having cylinder bores for heat retention of bore walls of the cylinder bores, having the heat retention material cartridge of any one of (1) or (2), and a metal-made or synthetic resin-made support member having a shape along the shape of the groove-like cooling water passage at the installation position of the heat retention tool, to which the heat retention material cartridge is fixed, wherein the heat retention material cartridge is fixed to the support member only at or near the center in the circular arc direction.

Further, present invention (4) provides an internal combustion engine in which the cylinder bore wall heat retention tool of (3) is installed.

Further, present invention (5) provides an automotive vehicle having the internal combustion engine of (4).

Advantageous Effects of Invention

According to the present invention, in the case of using the thermosensitive expansion rubber as a rubber member of the heat retention material cartridge, it is possible to provide the heat retention material cartridge capable of preventing the expanded thermosensitive expansion rubber from protruding from the upper or lower side of the heat retention material cartridge even when it thermo-sensitively expands in the groove-like cooling water passage.

DESCRIPTION OF EMBODIMENTS

Figure 1:
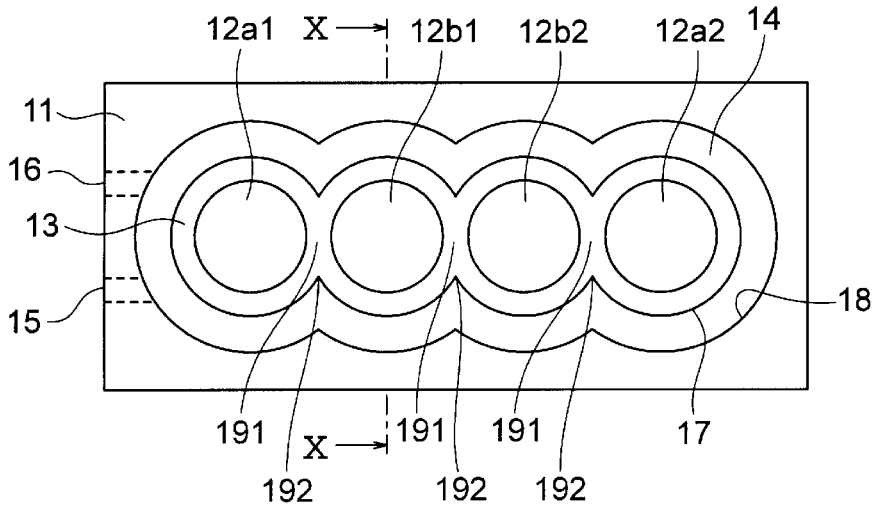
FIG. 1 is a schematic plan view illustrating an embodied example of a cylinder block on which a cylinder bore wall heat retention tool according to the present invention is installed.
Figure 2:
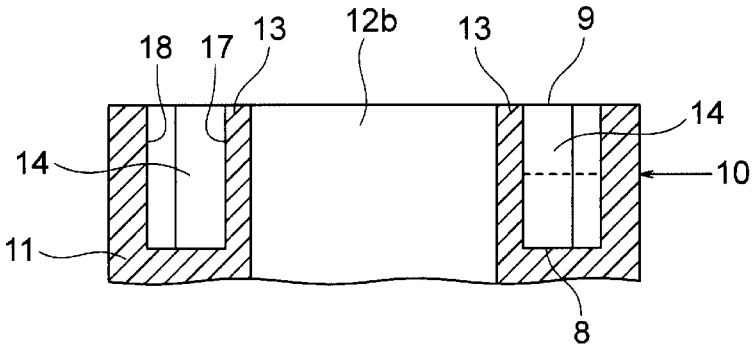
FIG. 2 is a cross-sectional view taken along a line x-x in FIG. 1.
Figure 3:
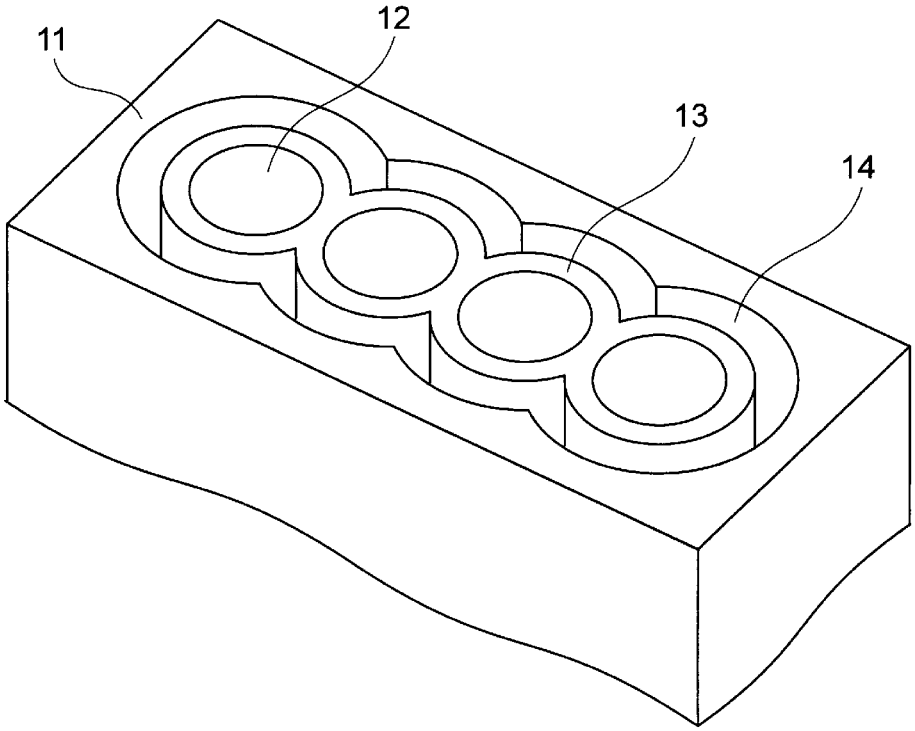
FIG. 3 is a perspective view illustrating the cylinder block illustrated in FIG. 1.
Figure 4:
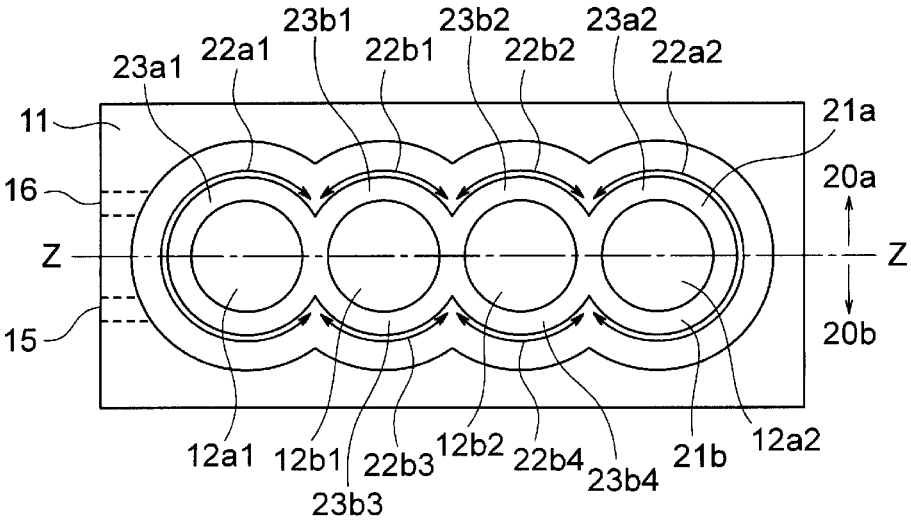
FIG. 4 is a schematic plan view illustrating an embodied example of the cylinder block on which the cylinder bore wall heat retention tool according to the present invention is installed.
Figure 5:
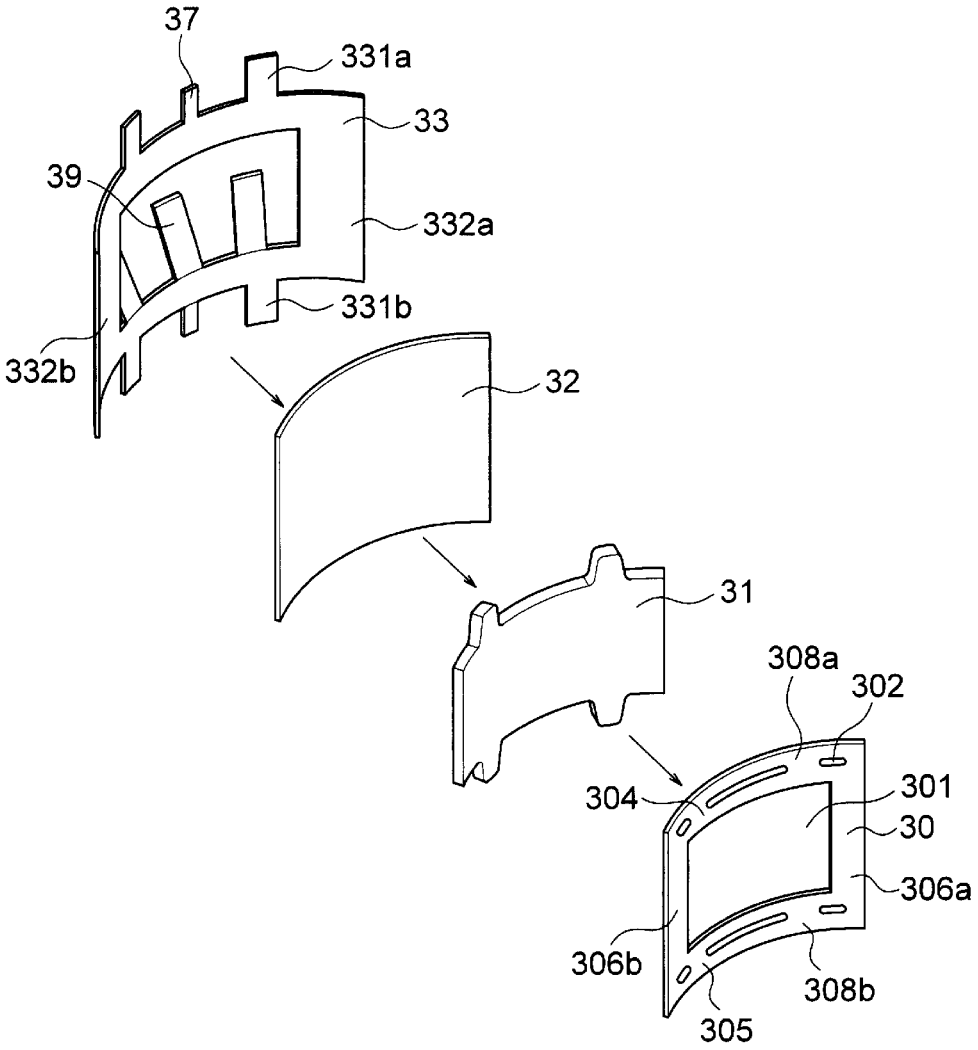
FIG. 5 is a schematic perspective view illustrating how the embodied example of a heat retention material cartridge according to the present invention is manufactured.
Figure 6:
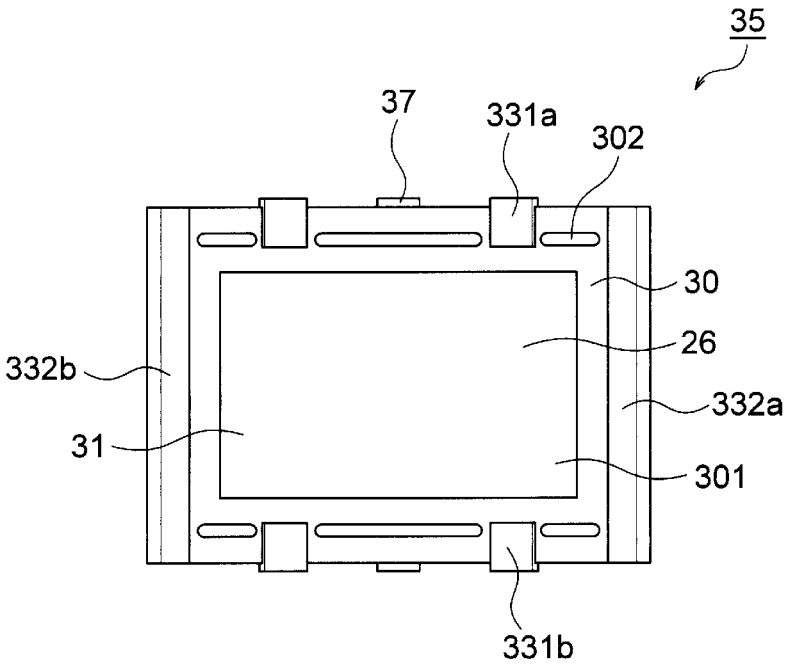
FIG. 6 is a schematic front view illustrating the embodied example (heat retention material cartridge 35) of the heat retention material cartridge according to the present invention.
Figure 7:
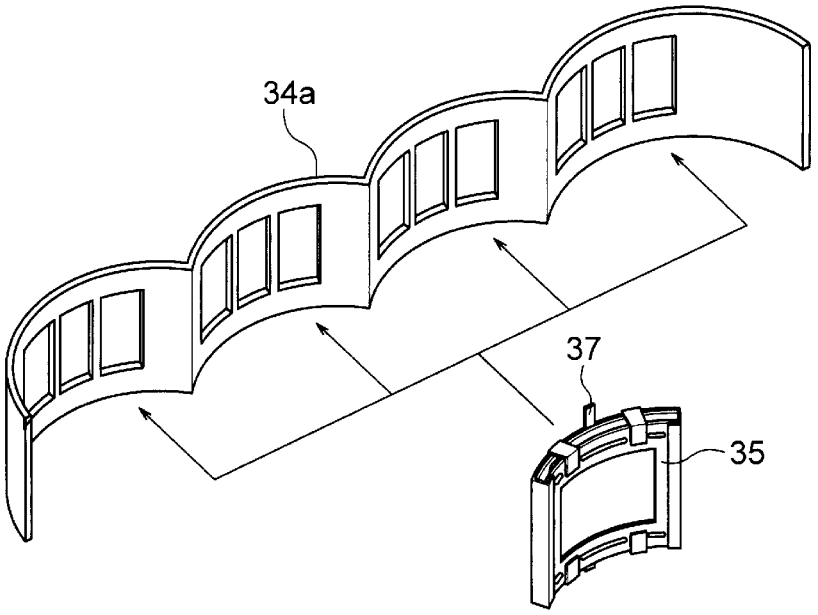
FIG. 7 is a view illustrating how the heat retention material cartridge 35 illustrated in FIG. 6 is fixed to a support member 34.
Figure 8:
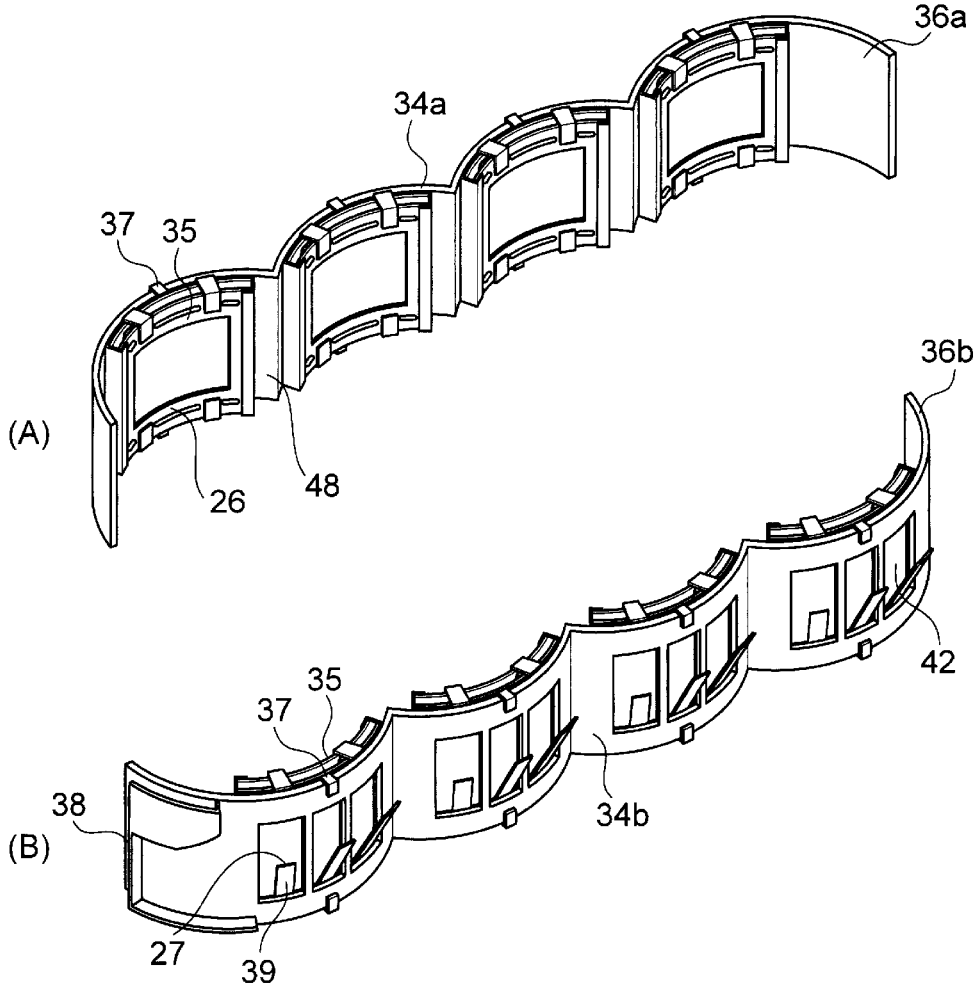
FIG. 8 is a schematic perspective view illustrating an embodied example (cylinder bore wall heat retention tool 36) of the cylinder bore wall heat retention tool according to the present invention.
Figure 9:
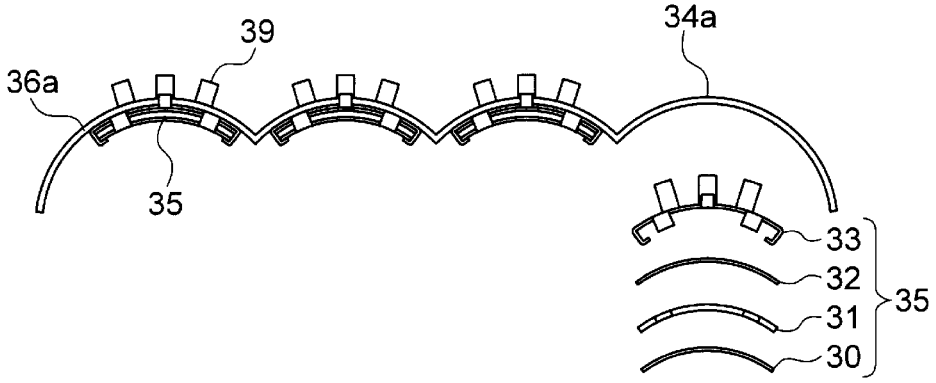
FIG. 9 is a view illustrating a cylinder bore wall heat retention tool 36 viewed from above.
Figure 10:
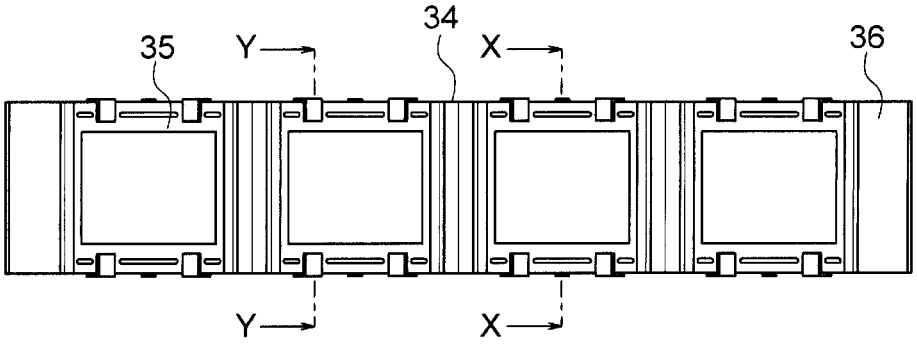
FIG. 10 is a view illustrating the cylinder bore wall heat retention tool 36 in FIG. 8 viewed from the side, as viewed from the front side (contact surface side of a thermosensitive expansion rubber 31).
Figure 11:
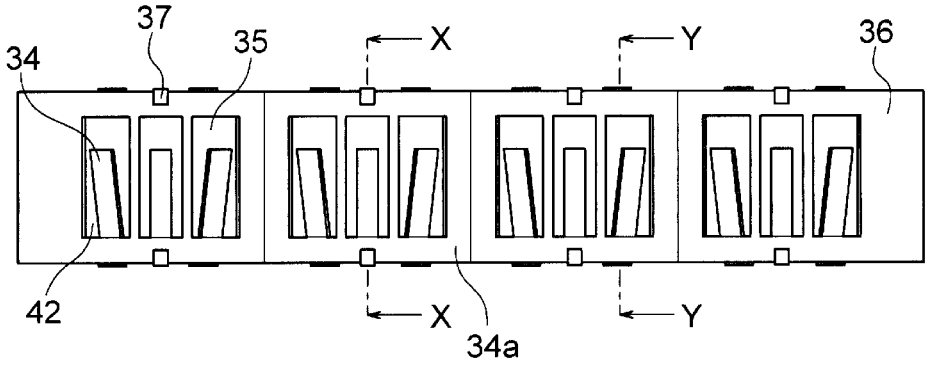
FIG. 11 is a view illustrating the cylinder bore wall heat retention tool 36 in FIG. 8 viewed from the side, as viewed from the back side.
Figure 12:
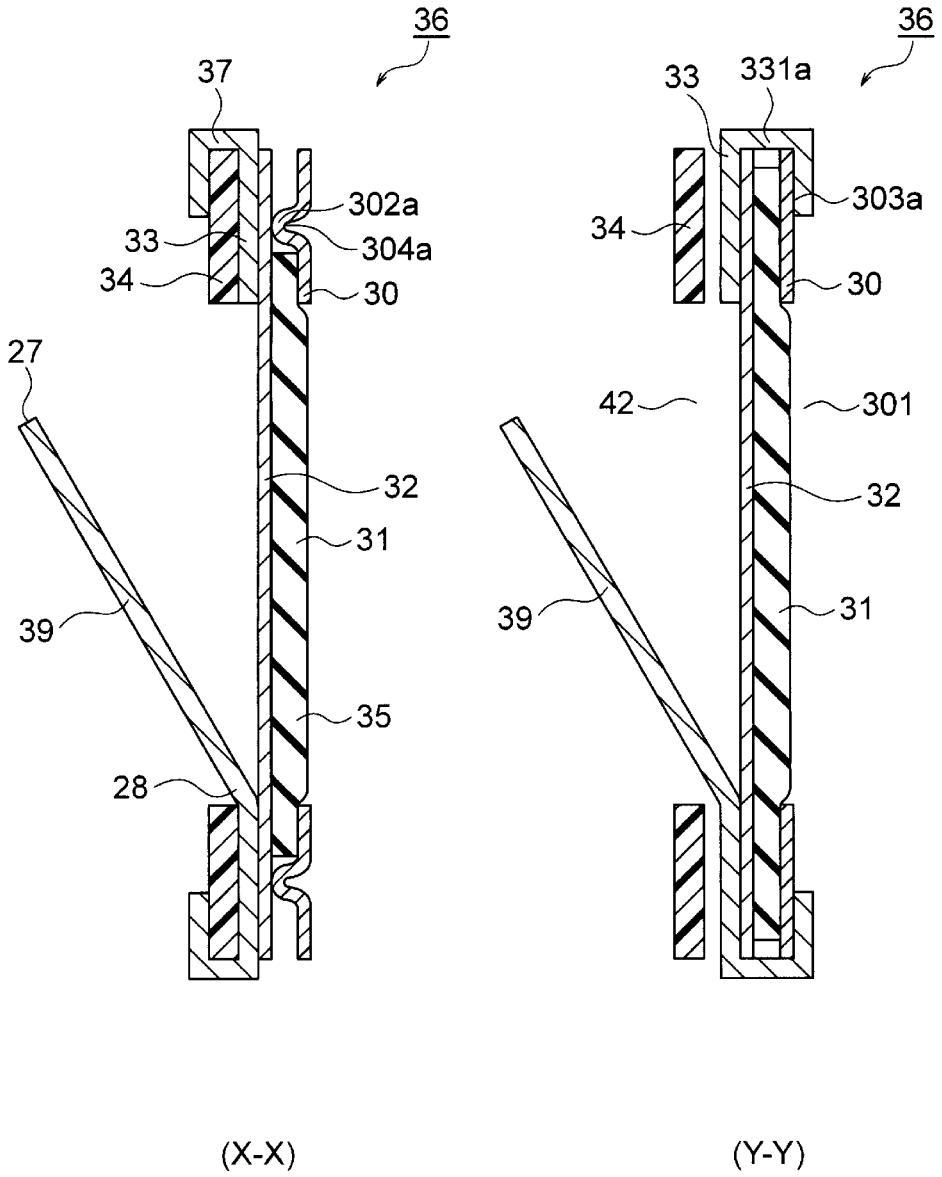
FIG. 12 is end views taken along lines X-X and Y-Y of FIGS. 10 and 11.
Figure 13:
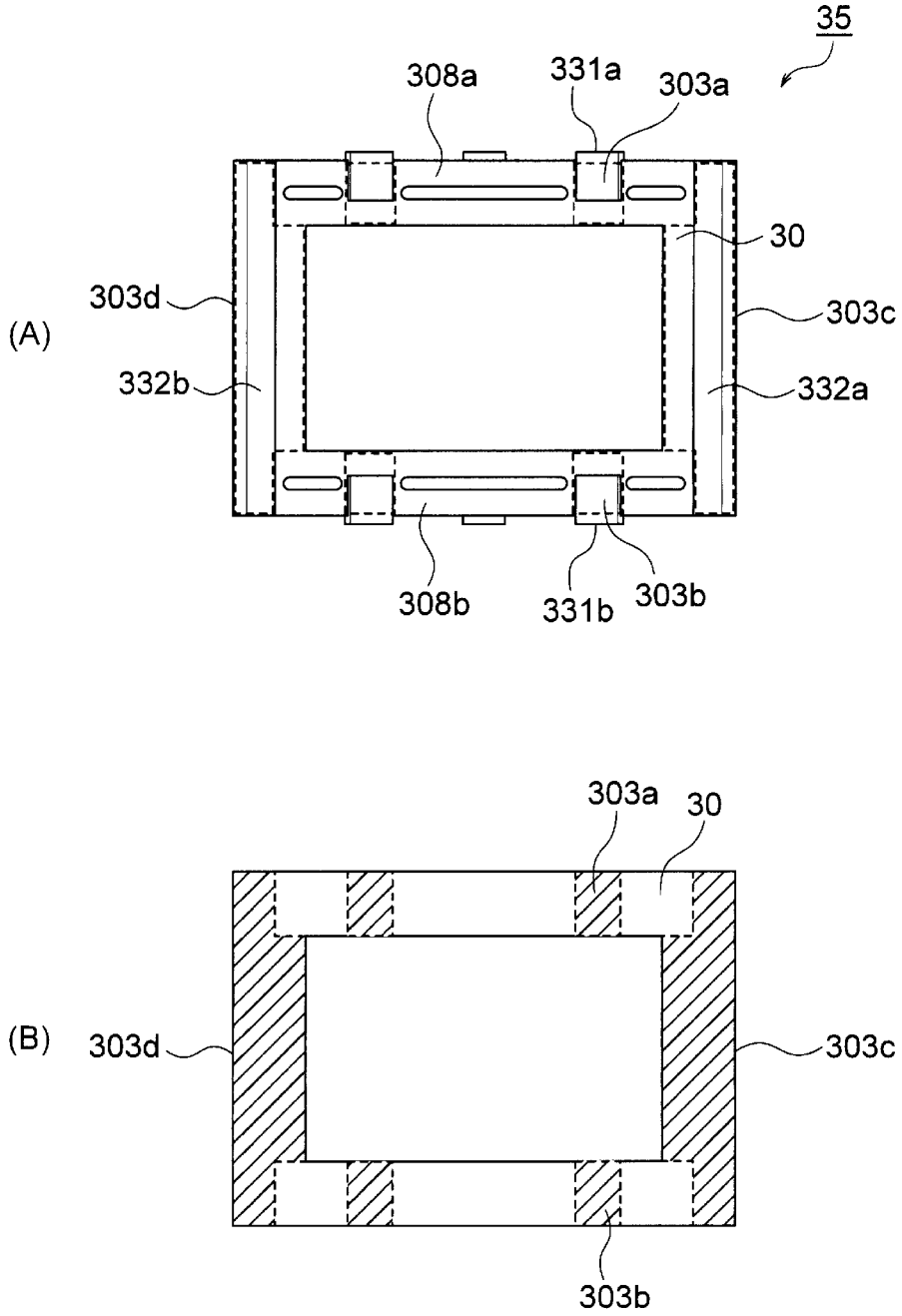
FIG. 13 is a view illustrating portions 303 of a front-side abutting plate 30, which are sandwiched at the outer end thereof by bendable portions, viewed from the front side.
Figure 14:
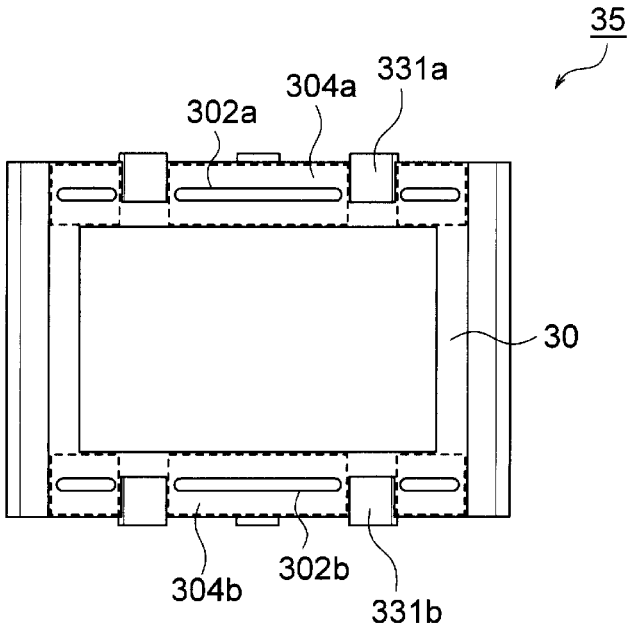
FIG. 14 is a view illustrating portions 304 of the front-side abutting plate 30, which are not sandwiched at the outer end thereof by the bendable portions, viewed from the front side.
Figure 14:
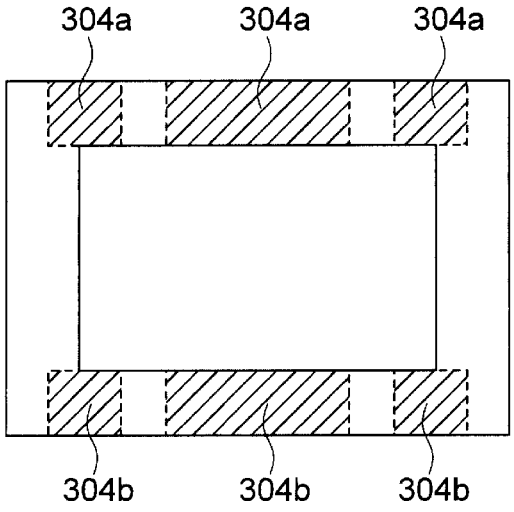
Figure 15:
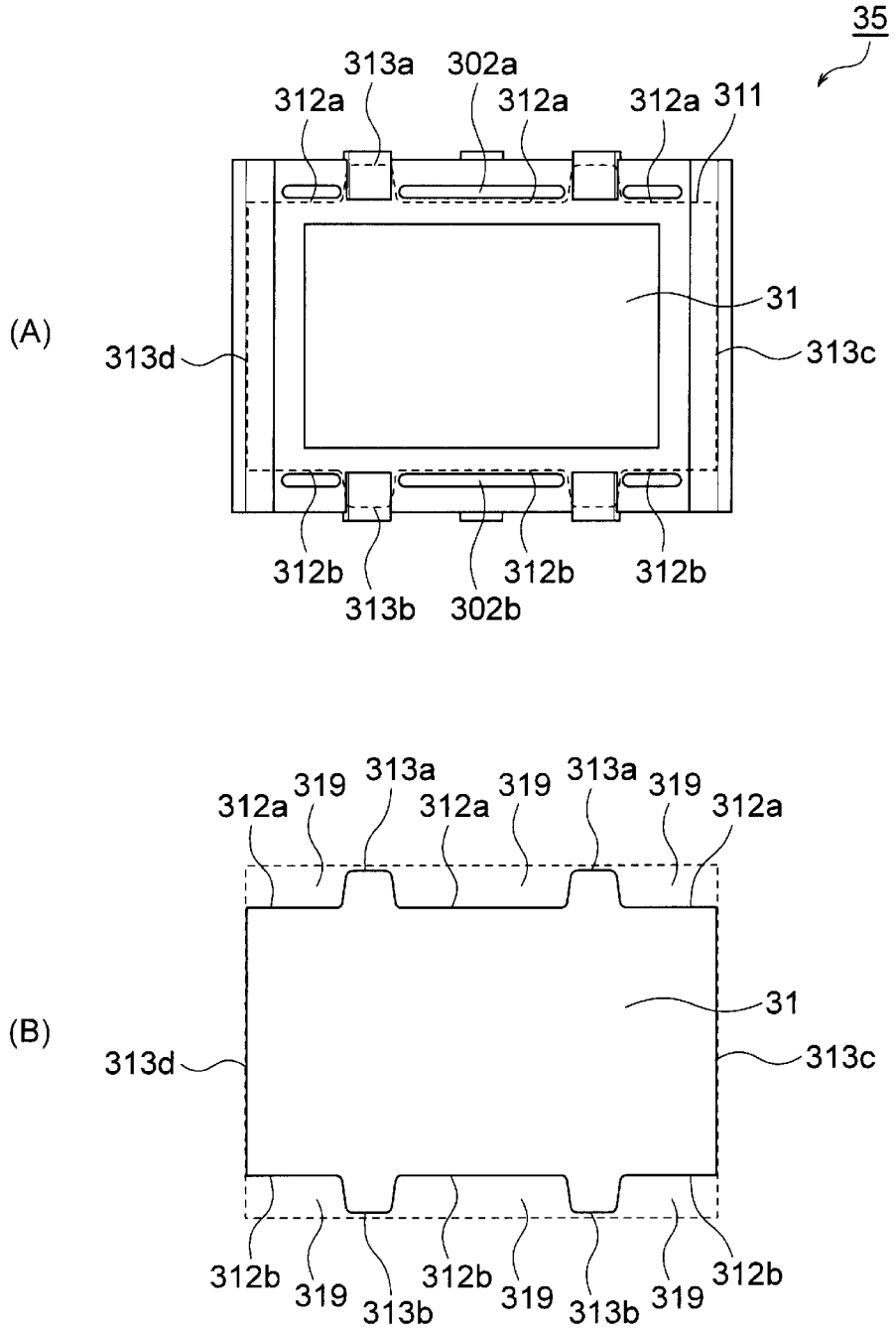
FIG. 15 is a view illustrating a thermosensitive expansion rubber 31 in the heat retention material cartridge 35.
Figure 16:
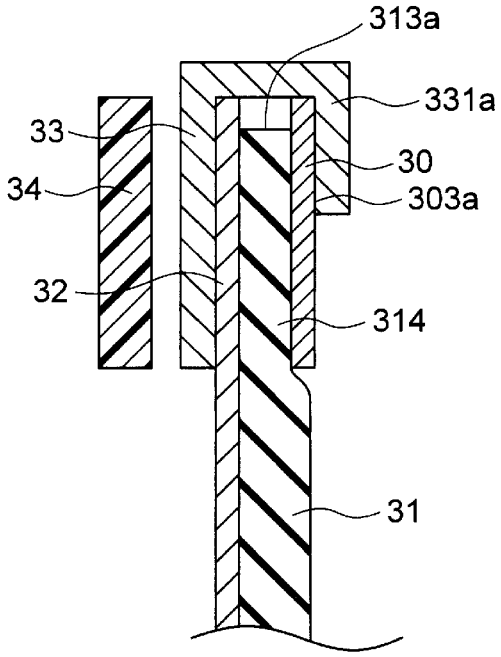
FIG. 16 is an enlarged view illustrating an upper side of the cylinder bore wall heat retention tool 36 in FIG. 12 (Y-Y).
Figure 17:
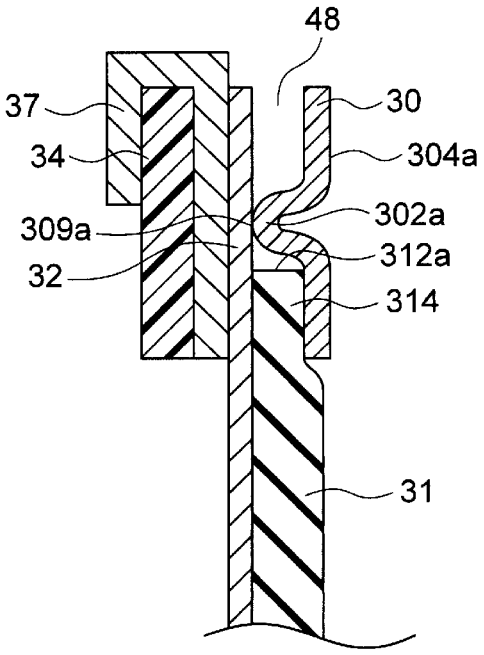
FIG. 17 is an enlarged view illustrating an upper side of the cylinder bore wall heat retention tool 36 in FIG. 12 (X-X).
Figure 18:
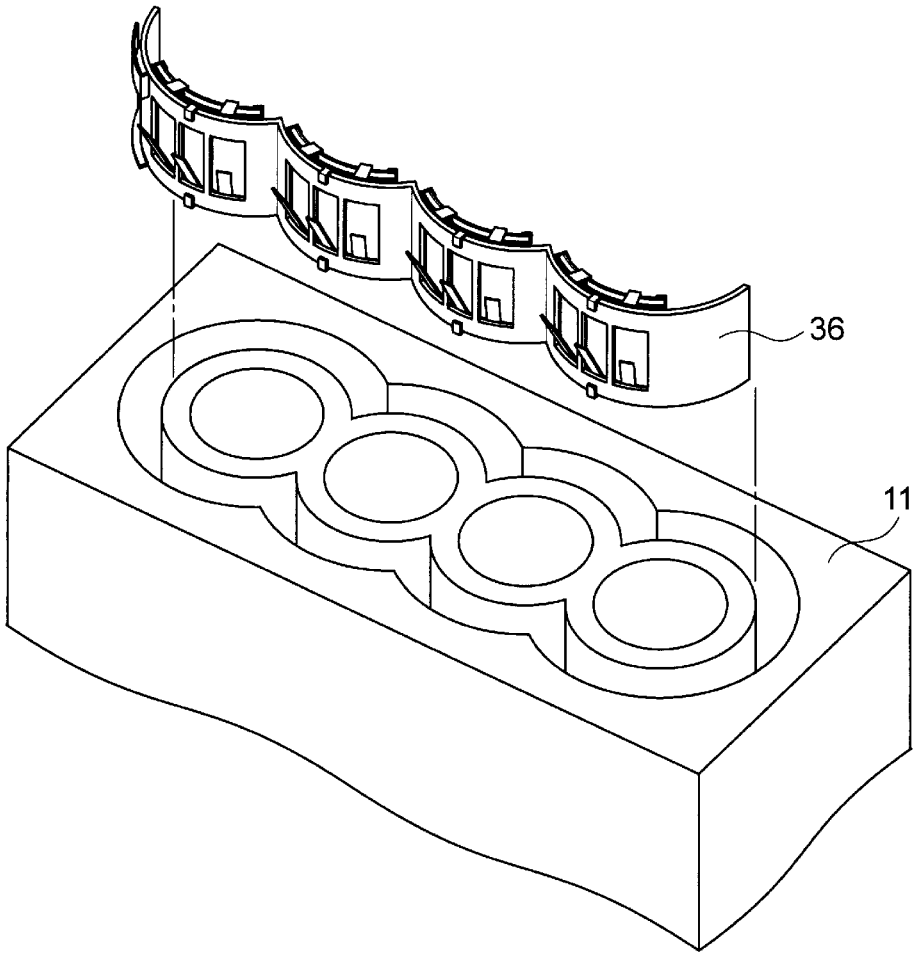
FIG. 18 is a schematic view illustrating how the cylinder bore wall heat retention tool 36 is installed on a cylinder block 11 illustrated in FIG. 1.
Figure 19:
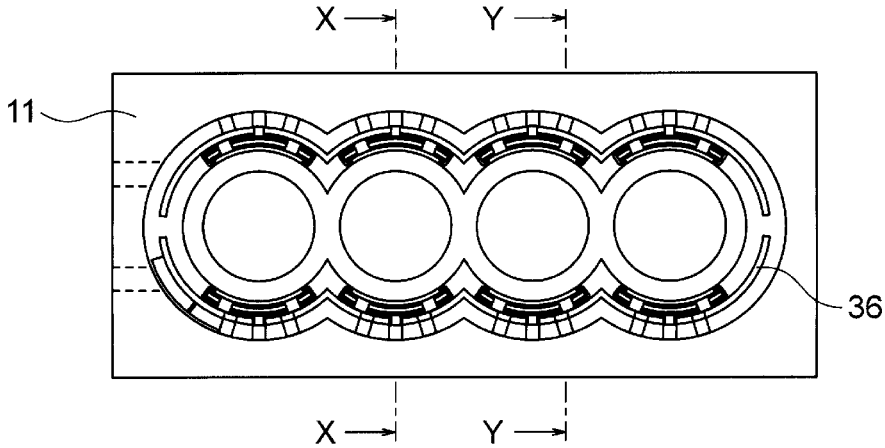
FIG. 19 is a schematic view illustrating the state of the cylinder bore wall heat retention tool 36 installed on the cylinder block 11 illustrated in FIG. 1.
Figure 20:
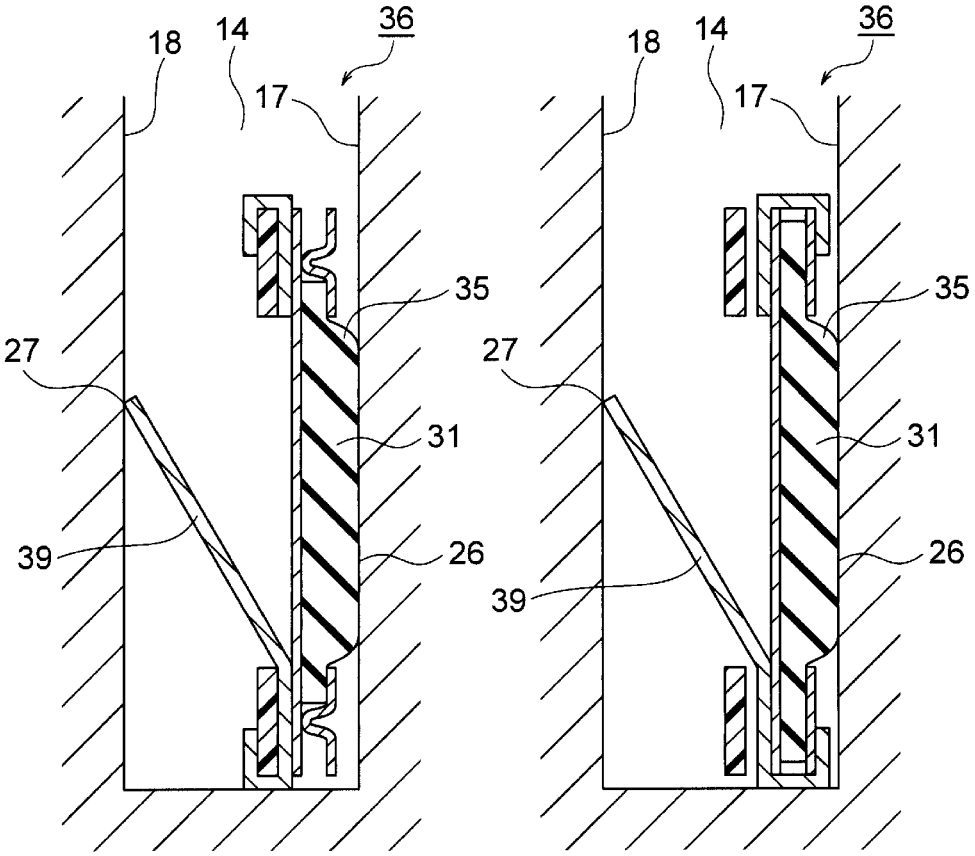
FIG. 20 is end views illustrating the state of the thermosensitive expansion rubber 31 expanding in a groove-like cooling water passage 14.
Figure 21:
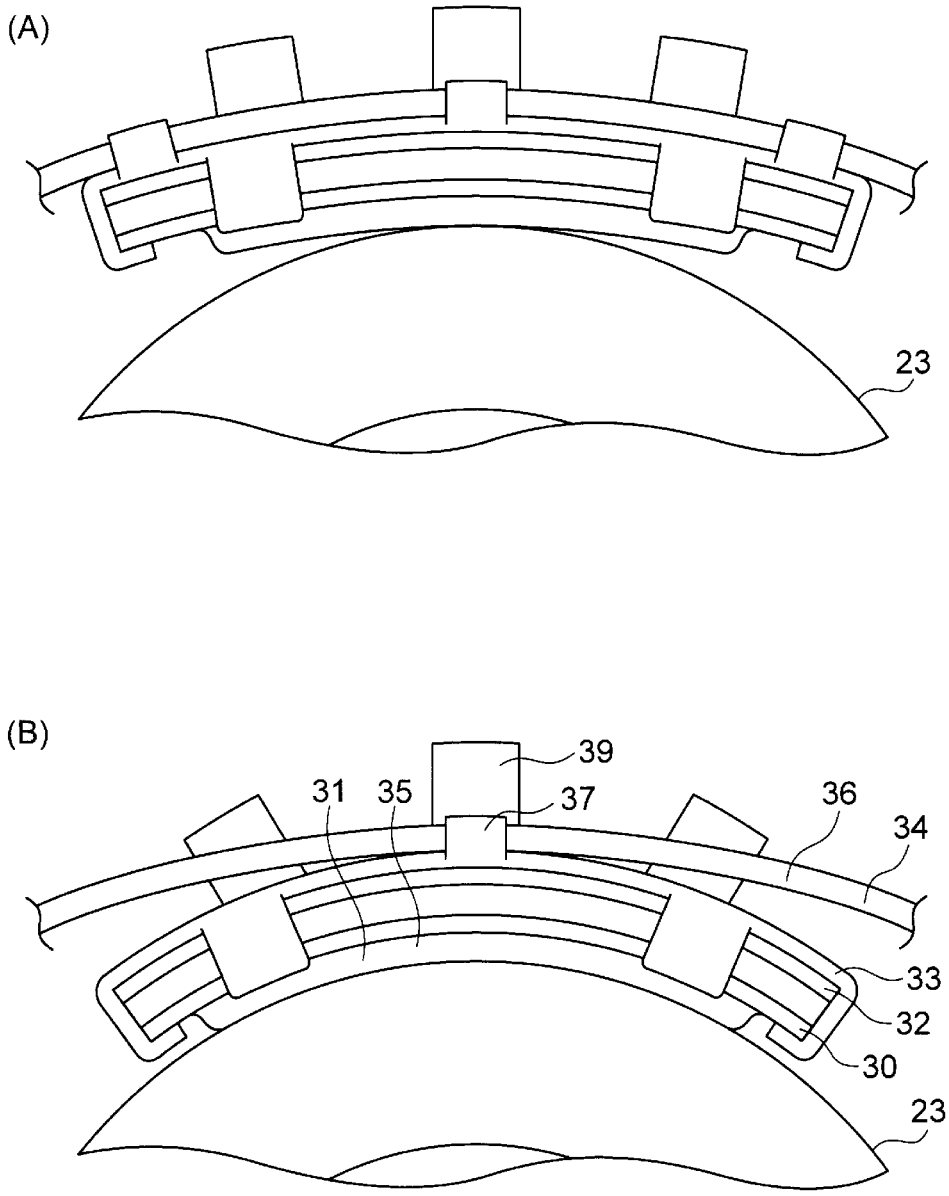
FIG. 21 is a view illustrating how the heat retention material cartridge comes into contact with a bore wall.

A cylinder bore wall heat retention tool according to the present invention and an internal combustion engine according to the present invention will be described with reference to FIGS. 1 to 21. FIGS. 1 to 4 each illustrate an embodied example of a cylinder block on which the cylinder bore wall heat retention tool according to the present invention is installed. FIGS. 1 and 4 are schematic plan views illustrating the cylinder block on which the cylinder bore wall heat retention tool according to the present invention is installed. FIG. 2 is a cross-sectional view taken along a line x-x in FIG. 1. FIG. 3 is a perspective view illustrating the cylinder block illustrated in FIG. 1. FIG. 5 is a schematic perspective view illustrating how an embodied example of a heat retention material cartridge according to the present invention is manufactured. FIG. 6 is a schematic front view illustrating the embodied example of the heat retention material cartridge (heat retention material cartridge 35) according to the present invention. FIG. 7 is a view illustrating how the heat retention material cartridge 35 illustrated in FIG. 6 is fixed to a support member 34. FIG. 8 is a schematic perspective view illustrating an embodied example of the cylinder bore wall heat retention tool (cylinder bore wall heat retention tool 36) according to the present invention, in which (A) is a view viewed from the front on the upper diagonal side, and (B) is a view viewed form the back on the upper diagonal side. FIG. 9 is a view illustrating the cylinder bore wall heat retention tool 36 viewed from above. In FIG. 9, of the heat retention material cartridges 35 fixed to the cylinder bore wall heat retention tool 36, a right-end heat retention material cartridge is illustrated separately for each constituent member. FIG. 10 is a view illustrating the cylinder bore wall heat retention tool 36 in FIG. 8 viewed from the side, as viewed from the front side (contact surface side of a thermosensitive expansion rubber 31). FIG. 11 is a view illustrating the cylinder bore wall heat retention tool 36 in FIG. 8 viewed from the side, as viewed from the back side. FIG. 12 is end views taken along lines X-X and Y-Y in FIGS. 10 and 11. FIG. 13 is a view illustrating portions 303 of a front-side abutting plate 30, which are sandwiched at the outer end thereof by bendable portions, viewed from the front side, in which (A) is a view illustrating the portions of the front-side abutting plate 30 sandwiched at the outer end thereof by the bendable portions, and (B) is a view illustrating only the front-side abutting plate 30. FIG. 14 is a view illustrating portions 304 of the front-side abutting plate 30, which are not sandwiched at the outer end thereof by the bendable portions, viewed from the front side, in which (A) is a view illustrating the portions of the front-side abutting plate 30, which are not sandwiched at the outer end thereof by the bendable portions, and (B) is a view illustrating only the front-side abutting plate 30. FIG. 15 is a view illustrating the thermosensitive expansion rubber 31 in the heat retention material cartridge 35, as viewed from the front side, in which (A) is a view illustrating the contour of the thermosensitive expansion rubber 31 installed in the heat retention material cartridge 35, and (B) is a view illustrating only the thermosensitive expansion rubber 31. FIG. 16 is an enlarged view illustrating an upper side of the cylinder bore wall heat retention tool 36 in FIG. 12 (Y-Y). FIG. 17 is an enlarged view illustrating an upper side of the cylinder bore wall heat retention tool 36 in FIG. 12 (X-X). FIG. 18 is a schematic view illustrating how the cylinder bore wall heat retention tool 36 is installed on a cylinder block 11 illustrated in FIG. 1. FIG. 19 is a schematic view illustrating the state of the cylinder bore wall heat retention tool 36 installed on the cylinder block 11 illustrated in FIG. 1. FIG. 20 is end views illustrating the state of the thermosensitive expansion rubber 31 expanded in a groove-like cooling water passage 14, in which (X-X) is an end view taken along a line X-X in FIG. 19 and (Y-Y) is an end view taken along a line Y-Y in FIG. 19. FIG. 21 is a view illustrating how the heat retention material cartridge comes into contact with a bore wall.

As illustrated in FIGS. 1 to 3, bores 12 for causing pistons to move up and down and the groove-like cooling water passage 14 for causing cooling water to flow are formed in the open-deck-type cylinder block 11 of an internal combustion engine to be mounted on a vehicle, on which the cylinder bore wall heat retention tool is installed. A wall partitioning the bores 12 and the groove-like cooling water passage 14 is a cylinder bore wall 13. Further, a cooling water supply port 15 for supplying cooling water to the groove-like cooling water passage 11 and a cooling water discharge port 16 for discharging the cooling water from the groove-like cooling water passage 11 are formed in the cylinder block 11.

Two or more bores 12 are formed in series in the cylinder block 11. Therefore, the bores 12 include end bores **12*a*1 and 12*a*2 neighboring to one bore and intermediate bores 12*b*1 and 12*b*2 interposed between two bores (the cylinder block includes only two end bores when the number of bores of the cylinder block is two). Among the bores aligned in series, the end bores 12*a*1 and 12*a*2 are bores positioned at both ends, and the intermediate bores 12*b*1 and 12*b*2 are bores disposed between the end bore 12*a*1 positioned at one end and the end bore 12*a*2 positioned at the other end. Since a wall between the end bore 12*a*1 and the intermediate bore 12*b*1, a wall between the intermediate bore 12*b*1 and the intermediate bore 12*b*2, and a wall between the intermediate bore 12*b*2 and the end bore 12*a*2 (i.e., inter-bore walls 191) are portions sandwiched between two bores, heat is transferred from two cylinder bores. Therefore, the wall temperature becomes higher than the other walls. Accordingly, the temperature is highest in the vicinity of the inter-bore wall 191 on a cylinder bore-side wall surface 17 of the groove-like cooling water passage 14. Therefore, on the cylinder bore-side wall surface 17 of the groove-like cooling water passage 14, the temperature at a boundary 192** of the bore wall of each cylinder bore and the vicinity thereof becomes highest.

Further, in the present invention, among the wall surfaces of the groove-like cooling water passage 14, the wall surface on the cylinder bore 13 side are described as the cylinder bore-side wall surfaces 17 of the groove-like cooling water passage. Among the wall surfaces of the groove-like cooling water passage 14, the wall surfaces on the side opposite to the cylinder bore-side wall surfaces 17 of the groove-like cooling water passage are described as wall surfaces 18.

Further, in the present invention, one side half refers to half at one side when the cylinder block is vertically divided into two in a direction in which the cylinder bores are aligned. Accordingly, in the present invention, one side half bore wall of the bore walls of all the cylinder bores refer to bore walls at one side half when all the cylinder bore walls are vertically divided into two in the direction in which the cylinder bores are aligned. For example, in FIG. 4, the direction in which the cylinder bores are aligned is a Z-Z direction, and each bore wall of one side half when vertically divided into two along the line Z-Z constitutes the one side half bore wall of the bore walls of all the cylinder bores. This is, in FIG. 4, one side half bore wall on a side indicated by 20*a* with respect to the line Z-Z is a bore wall 21*a* of one side half of the bore walls of all the cylinder bores, and one side half bore wall on a side indicated by 20*b* with respect to the line Z-Z is a bore wall 21*b* of the other side half of the bore walls of all the cylinder bores. Further, one side of all the cylinder bore walls refers to either the one side half bore wall 21*a* or the one side half bore wall 21*b*, and a part on one side refers to a part of the one side half bore wall 21*a* or a part of the one side half bore wall 21*b*.

Further, in the present invention, the bore wall of each cylinder bore refers to each bore wall portion corresponding to each cylinder bore, and in FIG. 4, the range indicated by a two-directional arrow 22*a*1 is a bore wall 23*a*1 of the cylinder bore 12*a*1. The range indicated by a two-directional arrow 22*b*1 is a bore wall 23*b*1 of the cylinder bore 12*b*1. The range indicated by a two-directional arrow 22*b*2 is a bore wall 23*b*2 of the cylinder bore 12*b*2. The range indicated by a two-directional arrow 22*a*2 is a bore wall 23*a*2 of the cylinder bore 12*a*2. The range indicated by a two-directional arrow 22*b*3 is a bore wall 23*b*3 of the cylinder bore 12*b*1. The range indicated by a two-directional arrow 22*b*4 is a bore wall 23*b*4 of the cylinder bore 12*b*2. In other words, the bore wall 23*a*1 of the cylinder bore 12*a*1, the bore wall 23*b*1 of the cylinder bore 12*b*1, the bore wall 23*b*2 of the cylinder bore 12*b*2, the bore wall 23*a*2 of cylinder bore 12*a*2, the bore wall 23*b*3 of the cylinder bore 12*b*1, and the bore wall 23*b*4 of the cylinder bore 12*b*2 are bore walls of respective cylinder bores.

As illustrated in FIG. 5, the heat retention material cartridge 35 includes an elastic member attached member 33 to which a metal plate spring 39 is attached and being arc-shaped when viewed from above, a back-side pressing member 32 being arc-shaped when viewed from above, the thermosensitive expansion rubber 31, and the front-side abutting plate 30 being arc-shaped when viewed from above, which are sequentially overlapped. In manufacturing, as illustrated in FIG. 6, bendable portions 331*a* formed at an upper end of the elastic member attached member 33, bendable portions 331*b* formed at a lower end of the elastic member attached member 33, a bendable portion 332*a* formed at a right end of the elastic member attached member 33, and a bendable portion 332*b* formed at a left end of the elastic member attached member 33 are bent toward the front-side abutting plate 30, so that the back-side pressing member 32, the thermosensitive expansion rubber 31, and the front-side abutting plate 30 are sandwiched between the bendable portions 331*a*, 331*b*, 332*a*, and 332*b* and the elastic member attached member 33, thereby fixing these members.

Then, as illustrated in FIG. 7, each heat retention material cartridge 35 is fixed to each bore portion of the support member 34 formed into the shape along the groove-like cooling water passage 14 in which the cylinder bore wall heat retention tool 36 is installed, that is, the shape including plural arcs that are continuous when viewed from above. The fixing of the heat retention material cartridge 35 to the support member 34 is performed by bending bendable portions 37 formed at the upper and lower ends of the elastic member attached member 33 toward the support member 34 so that the support member 34 is sandwiched between the bendable portions 37 and the elastic member attached member 33, thereby fixing the heat retention material cartridge 35 to the support member 34.

The cylinder bore wall heat retention tool 36 illustrated in FIG. 8 is a heat retention tool for heat retention of the one side half bore wall 21*b* (the side indicated by 20*b*) in FIG. 4. A cooling water flow partition member 38 is attached to the cylinder bore wall heat retention tool 36. The cooling water flow partition member 38 is a member for partitioning the cooling water supply port 15 and the cooling water discharge port 16 in such a manner that, in the cylinder block 11 illustrated in FIG. 4, cooling water supplied from the cooling water supply port 15 to the groove-like cooling water passage 14 initially flows in the groove-like cooling water passage 14 of one side half on the side indicated by 20*b* toward the end opposite to the position of the cooling water supply port 15, without being directly discharged from the neighboring cooling water discharge port 16, and when it reaches the end of the groove-like cooling water passage 14 of one side half on the side indicated by 20*b* opposite to the position of the cooling water supply port 15, turns and enters into the groove-like cooling water passage 14 of one side half of the side indicated by 20*a*, subsequently, flows in the groove-like cooling water passage 14 of one side half of the side indicated by 20*a* toward the cooling water discharge port 16, and is finally discharged from the cooling water discharge port 16. Although the cylinder block illustrated in FIG. 4 is configured in such a manner that the cooling water having flowed to the end of the groove-like cooling water passage 14 of one side half of the side indicated by 20*a* is discharged from the cooling water discharge port 16 formed at the side of the cylinder block 11, the cylinder block may be configured, for example, to cause the cooling water having flowed in the groove-like cooling water passage 14 of one side half of the side indicated by 20*a* from one end to the other end to flow into the cooling water passage formed in the cylinder head, without being discharged from the side of the cylinder block.

As illustrated in FIGS. 8 to 11, the cylinder bore wall heat retention tool 36 is a heat retention tool for heat retention of the one side half bore wall 21*b* of the cylinder block 11 illustrated in FIG. 4. The one side half bore wall 21*b* of the cylinder block 11 is constituted by bore walls of four cylinder bores of the bore wall 23*a*1 of the cylinder bore 12*a*1, the bore wall 23*b*3 of the cylinder bore 12*b*1, the bore wall 23*b*4 of the cylinder bore 12*b*2, and the bore wall 23*a*2 of the cylinder bore 12*a*2. The cylinder bore wall heat retention tool 36 is provided with the heat retention material cartridge for heat retention of the bore wall of each of the four cylinder bores. Therefore, the cylinder bore wall heat retention tool 36 is provided with four heat retention material cartridges 35.

The heat retention material cartridges 35 are fixed to the cylinder bore wall heat retention tool 36 in such a manner that the cylinder bore-side wall surface face a contact surface 26 of the thermosensitive expansion rubber 31 so that the contact surface 26 of the thermosensitive expansion rubber 31 can be brought into contact with the cylinder bore-side wall surface 17 of the groove-like cooling water passage 14. Further, on the back side of the cylinder bore wall heat retention portion 36, the metal plate spring 39 attached to the heat retention material cartridge 35 protrudes through an opening 42 of the support member 34 toward the side opposite to the thermosensitive expansion rubber 31. Then, when the thermosensitive expansion rubber 31 expands in the groove-like cooling water passage, a protruding tip end 27 of the metal plate spring 39 comes into contact with the wall surface 18 on the side opposite to the cylinder bore-side wall surface 17 of the groove-like cooling water passage 14.

The heat retention material cartridge 35 fixed to the cylinder bore wall heat retention portion 36, as illustrated in FIG. 5, is constituted by the front-side abutting plate 30, the thermosensitive expansion rubber member 31, the back-side pressing member 32, and the elastic member attached member 33.

The thermosensitive expansion rubber 31 is a member thermo-sensitively expanding in the groove-like cooling water passage, directly coming into contact with a bore wall 22 of each cylinder bore, and covering the heat retention portion of the bore wall 22, for heat retention of the bore wall 22 of each cylinder bore. Further, the back-side pressing member 32 is arc-shaped when viewed from above and has a shape along the back side of the thermosensitive expansion rubber 31 (the surface on the side opposite to the contact surface 26), so that the thermosensitive expansion rubber 31 can be entirely pressed from the back side of the thermosensitive expansion rubber 31. Further, the metal plate spring 39 that is an elastic member being arc-shaped when viewed from above and having a shape along the back side of the back-side pressing member 32 (the surface on the side opposite to the thermosensitive expansion rubber 31) is attached to the elastic member attached member 33. The metal plate spring 39 is a vertically long rectangular metal plate and has one end in the longitudinal direction connected to the elastic member attached member 33. The metal plate spring 39 is attached to the elastic member attached member 33 in such a manner that the tip end 27 is separated from the metal plate spring attachment member 33 and is bent from the elastic member attached member 33 at another end 28 connected to the metal plate spring attachment member 33. The front-side abutting plate 30 has an opening 301 being arc-shaped when viewed from above and rectangular when viewed from the front side. Then, when the bendable portions 331*a* formed at the upper end of the elastic member attached member 33, the bendable portions 331*b* formed at the lower end of the elastic member attached member 33, the bendable portion 332*a* formed at the right end of the elastic member attached member 33, and the bendable portion 332*b* formed at the left end of the elastic member attached member 33 are bent toward the front-side abutting plate 30, the back-side pressing member 32, the thermosensitive expansion rubber 31, and the front-side abutting plate 30 are sandwiched between the elastic member attached member 33 and the bendable portions 331*a*, 331*b*, 332*a*, and 332*b*, thereby fixing these members. The thermosensitive expansion rubber 31 has a surface on the side opposite to the back-side pressing member 32, which serves as the contact surface 26 coming into contact with the cylinder bore-side wall surface 17 of the groove-like cooling water passage.

As illustrated in FIGS. 13 and 14, the front-side abutting plate 30 includes portions 303 sandwiched at the outer end thereof by the bendable portions and the portions 304 not sandwiched by the bendable portions. In the heat retention material cartridge 35, an upper-side portion 308*a* of the front-side abutting plate 30 includes portions 303*a* sandwiched at the outer end thereof by the bendable portions 331*a*, a lower-side portion 308*b* of the front-side abutting plate 30 includes portions 303*b* sandwiched at the outer end thereof by the bendable portions 331*b*, a right-side portion of the front-side abutting plate 30 includes a portion 303*c* sandwiched at the outer end thereof by the bendable portion 332*a*, and a left-side portion of the front-side abutting plate 30 includes a portion 303*d* sandwiched at the outer end thereof by the bendable portion 332*b*. Further, in the heat retention material cartridge 35, the upper-side portion 308*a* of the front-side abutting plate 30 includes portions 304*a* not sandwiched at the outer end thereof by the bendable portions 331*a*, and the lower-side portion 308*b* of the front-side abutting plate 30 includes portions 304*b* not sandwiched at the outer end thereof by the bendable portions 331*b*. In FIG. 13, dotted lines indicate the portions of the front-side abutting plate 30 sandwiched at the outer end thereof by the bendable portions. Further, in FIG. 14, dotted lines indicate the portions of the front-side abutting plate 30 not sandwiched at the outer end thereof by the bendable portions.

Convex portions are formed in portions of the front-side abutting plate 30 not sandwiched at the outer end thereof by the bendable portions. That is, convex portions 302*a* extending in the longitudinal direction of the upper-side portion 308*a* of the front-side abutting plate 30 are formed in the portions 304*a* where the upper-side portion 308*a* is not sandwiched at the outer end thereof by the bendable portions 331*a*, of the front-side abutting plate 30. Further, convex portions 302*b* extending in the longitudinal direction of the lower-side portion of the front-side abutting plate 30 are formed in the portions 304*b* where the lower-side portion 308*b* of the front-side abutting plate 30 is not sandwiched at the outer end thereof by the bendable portions 331*b*.

As illustrated in FIGS. 15 to 17, the outer edge portion of the thermosensitive expansion rubber 31 is formed in such a manner that positions corresponding to the portions of the front-side abutting plate 30 not sandwiched by the bendable portions are cut out. Therefore, in the portions of the front-side abutting plate 30 where the convex portions 302*a* and 302*b* are formed, outer ends 312*a* and 312*b* of the thermosensitive expansion rubber 31 are positioned inside apexes 309*a* and 309*b* of the convex portions 302*a* and 302*b*. In FIG. 15(A), a dotted line indicates the contour of the thermosensitive expansion rubber 31. In FIG. 15(B), a dotted line (reference numeral 319) indicates the contour of the rectangular thermosensitive expansion rubber before being cut out. Further, the thermosensitive expansion rubber 31 is not cut out at positions corresponding to the portions of the front-side abutting plate 30 sandwiched by the bendable portions. At the portions 303*a* and 303*b* of the front-side abutting plate 30 sandwiched by the bendable portions, outer ends 313*a* and 313*b* of the thermosensitive expansion rubber 31 are positioned outside the apex positions of the convex portions 302*a* and 302*b*.

The support member 34 to which the heat retention material cartridge 35 is fixed is formed in a shape in which four circular arcs are continuous when viewed from above, and the shape of the support member 34 is a shape along one side half of the groove-like cooling water passage 14. Further, the support member 34 has the opening 42 so that the metal plate spring 39 attached to the heat retention material cartridge 35 can pass through the support member 34, from the back side of the cylinder bore wall heat retention tool 36, and protrude toward the wall surface 18 on the side opposite to the cylinder bore-side wall surface 17 of the groove-like cooling water passage 14.

The support member 34 is a member to which the heat retention material cartridge 35 is fixed, and plays a role in determining the position of the heat retention material cartridge 35 so that the position of the heat retention material cartridge 35 does not shift in the groove-like cooling water passage 14. The support member 34 is a metal plate or a molded body of a synthetic resin.

In the cylinder bore wall heat retention tool 36, the heat retention material cartridge 35 is fixed to the support member 34 only at or near the center in the circular arc direction when viewed from above (at or near the center of the arc-shaped heat retention material cartridge 35 when the heat retention material cartridge 35 is viewed from above). The X-X end view of FIG. 12 is an end view taken along the center of the heat retention material cartridge 35. In the X-X end view, it is illustrated that the upper and lower ends of the elastic member attached member 33 are fixed to the support member 34 by the bendable portions 37. On the other hand, the Y-Y end view of FIG. 12 is an end view taken along a position adjacent to the edge of the heat retention material cartridge 35. In the Y-Y end view, it is illustrated that the elastic member attached member 33 is not fixed to the support member 34.

The cylinder bore wall heat retention tool 36 is installed, for example, in the groove-like cooling water passage 14 of the cylinder block 11 illustrated in FIG. 1. As illustrated in FIG. 18, the cylinder bore wall heat retention tool 36 is inserted into the groove-like cooling water passage 14 of the cylinder block 11. Then, as illustrated in FIG. 19, the cylinder bore wall heat retention tool 36 is installed in the groove-like cooling water passage 14.

After the cylinder bore wall heat retention tool 36 is installed in the groove-like cooling water passage 14 of the cylinder block 11, when the internal combustion engine is driven, the thermosensitive expansion rubber 31 is heated and thermo-sensitively expands. Then, as illustrated in FIG. 20, the thermosensitive expansion rubber 31 expands toward the cylinder bore-side wall surface 17 through the opening 301 formed in the inner portion of the front-side abutting plate 30, and the contact surface 26 comes into contact with the cylinder bore-side wall surface 17. Even after the contact surface 26 has contacted the cylinder bore-side wall surface 17, the thermosensitive expansion rubber 31 continues to expand until it reaches an opened state. Therefore, the tip end 27 of the metal plate spring 39 is subjected to a force directing toward the elastic member attached member 33. As a result, since the metal plate spring 39 deforms in such a manner that the tip end 27 approaches the elastic member attached member 33, the metal plate spring 39 generates an elastic force for returning to the original position. Then, by this elastic force, the elastic member attached member 33 is pushed toward the cylinder bore-side wall surface 17 of the groove-like cooling water passage. As a result, by the back-side pressing member 32 pushed by the elastic member attached member 33, the thermosensitive expansion rubber 31 is pressed against the cylinder bore-side wall surface 17 of the groove-like cooling water passage. That is, when the cylinder bore wall heat retention tool 36 is installed in the groove-like cooling water passage 14 and the thermosensitive expansion rubber 31 is heated and thermo-sensitively expands, the metal plate spring 39 deforms and the elastic force generated to restore from the deformation urges the back-side pressing member 32 in such a way as to press the thermosensitive expansion rubber 31 against the cylinder bore-side wall surface 17 of the groove-like cooling water passage. Thus, the thermosensitive expansion rubber 31 of the heat retention material cartridge 35 of the cylinder bore wall heat retention tool 36 comes into contact with the bore wall surfaces of respective cylinder bores constituting one side half wall surface 17*b* of the entire cylinder bore-side wall surface 17 of the groove-like cooling water passage.

At this time, in the cylinder bore wall heat retention tool 36, since the heat retention material cartridge 35 is fixed to the support member 34 only at or near the center in the circular arc direction when the heat retention material cartridge 35 is viewed from above, when the metal plate spring 39 urges the elastic member attached member 33 and the back-side pressing member 32 of the heat retention material cartridge 35, the elastic member attached member 33, the back-side pressing member 32, the thermosensitive expansion rubber 31, and the front-side abutting plate 30 can deform independently of the support member 34. This will be described with reference to FIG. 21. In the manufacturing of the cylinder bore wall heat retention tool, the elastic member attached member 33, the back-side pressing member 32, the thermosensitive expansion rubber 31, and the front-side abutting plate 30 are processed so that their curvatures match the curvatures of the wall surfaces of the bore walls of respective cylinder bores with which the thermosensitive expansion rubber comes into contact. However, in fact, processing errors occur with respect to design values in any of the elastic member attached member 33, the back-side pressing member 32, the thermosensitive expansion rubber 31, the front-side abutting plate 30, and the wall surfaces of the bore walls of the respective cylinder bores. Then, when the curvatures of the elastic member attached member 33, the back-side pressing member 32, the thermosensitive expansion rubber 31, and the front-side abutting plate 30 become smaller than the curvatures of the wall surfaces of the bore walls of the respective cylinder bores due to processing errors of these members or the wall surfaces of the bore walls of the respective cylinder bores, if the heat retention material cartridge is entirely fixed to the support member (for example, fixed to the support member at a total of three positions near the center and both ends in the circular arc direction when the heat retention portion is viewed from above), the thermosensitive expansion rubber can come into contact with bore walls 23 of the respective cylinder bores at the portion near the center in the circular arc direction but cannot contact the bore walls at the portion adjacent to the edge, when urged by the metal plate spring, as illustrated in FIG. 21(A). On the other hand, when the curvatures of the elastic member attached member 33, the back-side pressing member 32, the thermosensitive expansion rubber 31, and the front-side abutting plate 30 become smaller than the curvatures of the wall surfaces of the bore walls of the respective cylinder bores, if the heat retention material cartridge 35 according to the present invention is fixed to the support member 34 only at or near the center in the circular arc direction when the heat retention material cartridge 35 is viewed from above, the portion of the heat retention material cartridge 35 adjacent to the edge is separated from the support member 34 and can deform toward the bore walls 23 of the respective cylinder bores when urged by the metal plate spring 39, as illustrated in FIG. 21(B). Therefore, the thermosensitive expansion rubber 31 can come into contact with the bore walls 23 of the respective cylinder bores not only at the portion near the center but also at the portion adjacent to the edge in the circular arc direction. Because of this, in the cylinder bore wall heat retention tool 36, even if the curvatures of the elastic member attached member 33, the back-side pressing member 32, the thermosensitive expansion rubber 31, and the front-side abutting plate 30 are different from the curvatures of the wall surfaces of the bore walls 23 of the respective cylinder bores due to processing errors, the thermosensitive expansion rubber 31 can be surely brought into contact with the wall surfaces of the bore walls of the respective cylinder bores. Therefore, the adhesion of the thermosensitive expansion rubber 31 to the wall surfaces of the bore walls 23 of the respective cylinder bores (the cylinder bore-side wall surface 17 of the groove-like cooling water passage 14) is enhanced.

Further, when the curvatures of the elastic member attached member, the back-side pressing member, the thermosensitive expansion rubber, and the front-side abutting plate are larger than the curvatures of the bore walls of the respective cylinder bores, if the heat retention material cartridge is entirely fixed to the support member, the curvatures of the elastic member attached member, the back-side pressing member, the thermosensitive expansion rubber, and the front-side abutting plate do not change. Therefore, there is a possibility that a gap may be formed between the thermosensitive expansion rubber and the bore walls in the vicinity of the center in the circular arc direction when viewed from above. On the other hand, in the cylinder bore wall heat retention tool 36, even if the curvatures of the elastic member attached member 33, the back-side pressing member 32, the thermosensitive expansion rubber 31, and the front-side abutting plate 30 are larger than the curvatures of the bore walls 23 of the respective cylinder bores, since the heat retention material cartridge 35 is fixed to the support member 34 only at or near the center in the circular arc direction, the heat retention material cartridge 35 is pushed by the elastic member 39 from the back side at or near the center in the circular arc direction, and the portions of the heat retention material cartridge 35 other than the center or portions near the center in the circular arc direction deform in such a manner that the heat retention material cartridge 35 opens outward at the portions adjacent to both ends in the circular arc direction, independently of the support member 34. Therefore, the thermosensitive expansion rubber 31 can come into contact with the bore walls 23 of the respective cylinder bores not only at or near the center but also at the portions adjacent to the edges in the circular arc direction. Because of this, in the cylinder bore wall heat retention tool 36, even if the curvatures of the elastic member attached member 33, the back-side pressing member 32, the thermosensitive expansion rubber 31, and the front-side abutting plate 30 are different from the curvatures of the wall surfaces of the bore walls 23 of the respective cylinder bores due to processing errors, the thermosensitive expansion rubber 31 can be surely brought into contact with the wall surfaces of the bore walls of the respective cylinder bores. Therefore, the adhesion of the thermosensitive expansion rubber 31 to the wall surfaces of the bore walls 23 of the respective cylinder bores (the cylinder bore-side wall surface 17 of the groove-like cooling water passage 14) is enhanced.

Although FIG. 21(A) illustrates large gaps formed between the contact surface of the heat retention material cartridge and the thermosensitive expansion rubber at both ends thereof entirely for the purpose of explaining the effects of the present invention, such large processing errors do not occur in practice. However, in fact, due to processing errors, small gaps may occur, or the contact surface of the rubber member and the bore wall may be partly separated.

In the heat retention material cartridge 35, as illustrated in FIG. 16, since the bendable portions 331*a* (331*b*, 332*a*, 332*b*) are present in the portions 303*a* (303*b*, 303*c*, 303*d*) of the front-side abutting plate 30 sandwiched at the outer end thereof by the bendable portions 331*a* (331*b*, 332*a*, 332*b*) in such a way as to cover the outer end 313*a* (313*b*, 313*c*, 313*d*) of the thermosensitive expansion rubber 31, the outer edge portion of the thermosensitive expansion rubber 31 does not protrude from the heat retention material cartridge 35 even when the thermosensitive expansion rubber 31 expands. Further, since the bendable portions 331*a* (331*b*, 332*a*, 332*b*) are present in such a way as to cover the outer end 313*a* (313*b*, 313*c*, 313*d*) of the thermosensitive expansion rubber 31, it is insensitive to the flow of cooling water. Therefore, the problem of breakage of the thermosensitive expansion rubber 31 by the cooling water does not occur.

In the heat retention material cartridge 35, as illustrated in FIG. 17, in the portions 304*a* of the front-side abutting plate 30 not sandwiched at the outer end thereof by the bendable portions 331*a*, the convex portions 302*a* extending in the longitudinal direction of the upper-side portion 308*a* of the front-side abutting plate 30 are present in such a way as to protrude toward the back-side pressing member 32 at the position outside the outer end 312*a* of the thermosensitive expansion rubber 31. Therefore, even when the thermosensitive expansion rubber 31 expands, the outer edge portion of the thermosensitive expansion rubber 31 cannot easily protrude from the heat retention material cartridge 35. Further, since the convex portions 302*a* are present outside the outer end 312*a* of the thermosensitive expansion rubber 31, even when the cooling water flows into a gap 48 between the back-side pressing member 32 and the front-side abutting plate 30, the flow velocity of the cooling water flowing toward the outer end 312*a* of the thermosensitive expansion rubber 31 becomes very slow due to the presence of the convex portions 302*a*. Therefore, the problem of breakage of the thermosensitive expansion rubber 31 by the cooling water does not occur.

The heat retention material cartridge according to a first aspect of the present invention is a heat retention material cartridge fixed to a base member of a heat retention tool of a cylinder bore's bore wall for heat retention of the cylinder bore wall, which includes the thermosensitive expansion rubber coming into contact with the cylinder bore-side wall surface of the groove-like cooling water passage and covering the cylinder bore-side wall surface of the groove-like cooling water passage, the back-side pressing member being arc-shaped when viewed from above, and provided on the back side of the thermosensitive expansion rubber for pressing the thermosensitive expansion rubber entirely from the back side toward the cylinder bore-side wall surface of the groove-like cooling water passage, the front-side abutting plate provided on the contact surface of the thermosensitive expansion rubber, having an arc-shape when viewed from above and having an rectangular opening when viewed from the front side, and cooperative with the back-side pressing member for sandwiching the outer edge portion of the thermosensitive expansion rubber, and the elastic member attached member to which the elastic member is attached, being arc-shaped when viewed from above, and provided on the back side of the back-side pressing member for urging toward the cylinder bore-side wall surface of the groove-like cooling water passage so that the back-side pressing member presses the thermosensitive expansion rubber, wherein the bendable portions are formed at the upper end, the lower end, the right end, and the left end of the elastic member attached member, and the bendable portions are bent toward the front-side abutting plate, so that the back-side pressing member, the thermosensitive expansion rubber, and the front-side abutting plate are sandwiched between the bendable portions and the elastic member attached member, there is the portion where the outer end is not sandwiched by the bendable portions at least at the upper-side portion and the lower-side portion of the front-side abutting plate, the convex portion being convex toward the back-side pressing member and extending in the longitudinal direction of the upper-side portion of the front-side abutting plate is formed in the portion where the outer end is not sandwiched by the bendable portions at the upper-side portion of the front-side abutting plate, and the convex portion being convex toward the back-side pressing member and extending in the longitudinal direction of the lower-side portion of the front-side abutting plate is formed in the portion where the outer end is not sandwiched by the bendable portions at the lower-side portion of the front-side abutting plate, and the outer edge portion of the thermosensitive expansion rubber is formed in such a manner that the outer end of the thermosensitive expansion rubber is positioned inside the apex of the convex portion, at the portion of the front-side abutting plate where the convex portion is formed.

The heat retention material cartridge according to the first aspect of the present invention is the heat retention material cartridge fixed to the base member of the cylinder bore wall heat retention tool for heat retention of the cylinder bore wall. The first heat retention material cartridge according to the present invention has the elastic member attached member to which the elastic member is attached and being arc-shaped when viewed from above, the back-side pressing member being arc-shaped when viewed from above, the thermosensitive expansion rubber thermo-sensitively expanding in the groove-like cooling water passage, having the contact surface coming into contact with the cylinder bore-side wall surface of the groove-like cooling water passage, and covering the cylinder bore wall, and the front-side abutting plate being arc-shaped when viewed from above, which are sequentially overlapped. The bendable portions formed at the upper end of the elastic member attached member, the bendable portions formed at the lower end of the elastic member attached member, the bendable portion formed at the right end of the elastic member attached member, and the bendable portion formed at the left end of the elastic member attached member are bent toward the front-side abutting plate, so that the back-side pressing member, the thermosensitive expansion rubber, and the front-side abutting plate are sandwiched between the elastic member attached member and the bendable portion, thereby fixing these members to the elastic member attached member. In the present invention, the upper end, the lower end, the right end, and the left end of the heat retention material cartridge are the upper end, the lower end, the right end, and the left end, respectively, when viewed from the front side, in other words, from the contact surface side of the thermosensitive expansion rubber.

The heat retention material cartridge according to the first aspect of the present invention is fixed to each bore portion of the support member formed into the shape along the groove-like cooling water passage in which the cylinder bore wall heat retention tool is installed, that is, the shape including plural arcs that are continuous when viewed from above. In fixing the heat retention material cartridge according to the first aspect of the present invention to the support member, the bendable portions formed at the upper and lower ends of the elastic member attached member are bent toward the support member, and the support member is sandwiched between the bendable portions and the elastic member attached member. As a result, the heat retention material cartridge according to the first aspect of the present invention is fixed to the support member. In the present invention, each bore portion of the support member refers to the portion of the support member the bore wall side of each cylinder bore and corresponds to one arc shape forming the support member when viewed from above.

The thermosensitive expansion rubber relating to the heat retention material cartridge according to the first aspect of the present invention is the member for thermo-sensitively expanding in the groove-like cooling water passage, so that the contact surface directly contacts the bore walls of the respective cylinder bores to cover the bore wall heat retention portion, for heat retention of the bore walls of the respective cylinder bores. A surface of the thermosensitive expansion rubber on the side opposite to the back-side pressing member is the contact surface that contacts the cylinder bore wall of the groove-like cooling water passage.

The thermosensitive expansion rubber is a composite obtained by impregnating and compressing a base foam material with a thermoplastic material having a melting point lower than that of the base foam material, and is a material capable of maintaining the compression state by a cured product of the thermoplastic material present at least in its surface layer at normal temperature and releasing the compression state when the cured product of the thermoplastic material is softened by heating. The thermosensitive expansion rubber is, for example, a thermosensitive expansion rubber described in Japanese Patent Laid-Open No. 2004-143262. When the material of the rubber member is the thermosensitive expansion rubber, the cylinder bore wall heat retention tool according to the present invention is installed in the groove-like cooling water passage, and heat is applied to the thermosensitive expansion rubber, thereby causing the thermosensitive expansion rubber to expand and deform into a predetermined shape.

Base foam materials for the thermosensitive expansion rubber include various polymer materials, such as rubber, elastomer, thermoplastic resin, thermosetting resin. Specifically, the materials include natural rubber, various synthetic rubbers such as chloropropylene rubber, styrene butadiene rubber, nitrile butadiene rubber, ethylene-propylene-diene ternary copolymer, silicone rubber, fluorine rubber, and acrylic rubber, various elastomers such as soft urethane, hard urethane, and various thermosetting resins such as phenol resin, and melamine resin.

Thermoplastic materials with any one of the glass transition point, melting point, and softening temperature of less than 120° C. are preferable for the thermosensitive expansion rubber. The thermoplastic materials for the thermosensitive expansion rubber include thermoplastic resins such as polyethylene, polypropylene, polystyrene, polyvinyl chloride, polyvinylidene chloride, polyvinyl acetate, polyacrylic ester, styrene butadiene copolymer, chlorinated polyethylene, polyvinylidene fluoride, ethylene vinyl acetate copolymer, ethylene vinyl acetate vinyl chloride acrylic acid ester copolymer, ethylene vinyl acetate acrylic acid ester copolymer, ethylene vinyl acetate vinyl chloride copolymer, nylon, acrylonitrile butadiene copolymer, polyacrylonitrile, polyvinyl chloride, polychloroprene, polybutadiene, thermoplastic polyimide, polyacetal, polyphenylene sulfide, polycarbonate, and thermoplastic polyurethane, and various thermoplastic compounds such as low-melting point glass frit, starch, solder, and wax.

The back-side pressing member relating to the heat retention material cartridge according to the first aspect of the present invention is arc-shaped when viewed from above, has the shape along the back side of the thermosensitive expansion rubber (the surface on the side opposite to the contact surface side) so that the entire thermosensitive expansion rubber can be pressed from the back side of the thermosensitive expansion rubber, and has the shape covering the entire back side or substantially the entire back side of the thermosensitive expansion rubber. The material of the back-side pressing member can be appropriately selected if it can deform in such a way as to press the thermosensitive expansion rubber toward the cylinder bore-side wall surface of the groove-like cooling water passage when pushed from the back side by the elastic member. Metal plates of stainless steel, aluminum alloy, and the like are preferable. The thickness of the back-side pressing member can be appropriately selected if it can deform in such a way as to press the rubber member toward the cylinder bore-side wall surface of the groove-like cooling water passage when pressed from the back side by the elastic member.

The elastic member attached member relating to the heat retention material cartridge according to the first aspect of the present invention is arc-shaped when viewed from above, and the elastic member is attached. Further, the bendable portions are formed at the upper, lower, right, and left ends of the elastic member attached member. The elastic member is the elastic urging member that enables the back-side pressing member to press the thermosensitive expansion rubber toward the cylinder bore-side wall surface of the groove-like cooling water passage, when the cylinder bore wall heat retention tool fixed to the heat retention material cartridge according to the first aspect of the present invention is installed in the groove-like cooling water passage, and the thermosensitive expansion rubber expands and elastically deforms.

When the heat retention material cartridge according to the first aspect of the present invention is viewed from above, two or more elastic members are attached in the circular arc direction of the heat retention material cartridge according to the first aspect of the present invention. In the case where the attachment place for the elastic member is only one, the elastic member is attached to the heat retention material cartridge according to the first aspect of the present invention at or near the center in the circular arc direction in order to press the heat retention tool entirely. However, in this case, since the heat retention material cartridge according to the first aspect of the present invention is fixed to the support member at or near the center, the heat retention material cartridge according to the first aspect of the present invention is pressed together with the support member. Therefore, in the heat retention material cartridge according to the first aspect of the present invention, independently of the support member, the portion adjacent to the edge of the heat retention material cartridge according to the first aspect of the present invention is not separated from the support member and does not deform in such a way as to press the thermosensitive expansion rubber toward the cylinder bore-side wall surface of the groove-like cooling water passage. Because of this, the elastic members need to be attached at least at two places in total, at one place near one end and at the other place near the other end, of the heat retention material cartridge according to the first aspect of the present invention, so that the portions adjacent to both edges of the heat retention material cartridge according to the first aspect of the present invention are separated and deform in such a way as to press the thermosensitive expansion rubber toward the cylinder bore-side wall surface of the groove-like cooling water passage, independently of the support member. Further, it is preferable that the elastic members are attached at three positions in total, at one place at or near the center in the circular arc direction of the heat retention material cartridge according to the first aspect of the present invention, at one place near one end and at another place near the other end of the heat retention material cartridge according to the first aspect of the present invention, so that the heat retention material cartridge according to the first aspect of the present invention is entirely pressed and the portions adjacent to both edges of the heat retention material cartridge according to the first aspect of the present invention are pressed independently of the support member. Further, to enhance the adhesion of the thermosensitive expansion rubber of the heat retention material cartridge according to the first aspect of the present invention to the cylinder bore-side wall surface of the groove-like cooling water passage, the elastic members can be attached at four portions or more in the circular arc direction.

The form of the elastic member is not particularly limited, and examples thereof include a plate-like elastic member, a coil-like elastic member, a leaf spring, a torsion spring, and elastic rubber. The material of the elastic member is not particularly limited, but stainless steel (SUS), aluminum alloy and the like are preferable because of excellent LLC resistance and high strength. As the elastic member, a metal elastic member such as a metal plate spring, a coil spring, a leaf spring, or a torsion spring, is preferable.

Figure 23:
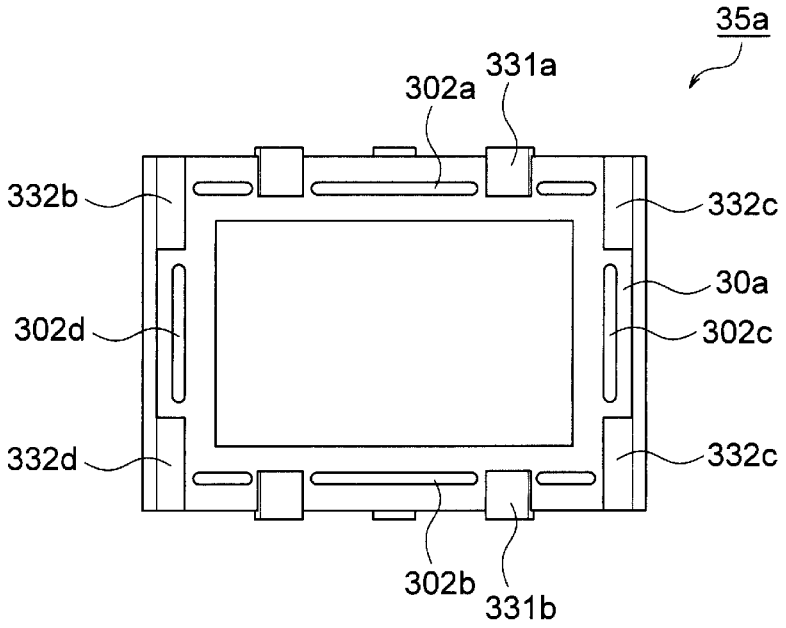
FIG. 23 is a schematic front view illustrating an embodied example of the heat retention material cartridge according to the present invention.

Among the bendable portions formed on the elastic member attached member, the bendable portions formed at the right and left ends can be formed over the whole of the up-and-down direction of the right or left side of the elastic member attached member, like the embodied example illustrated in FIG. 6, or can be formed partly at the right end or the left end of the elastic member attached member in the up-and-down direction, like the embodied example illustrated in FIG. 23. In the case where the bendable portions are partly formed at the right end or the left end of the elastic member attached member, convex portions are formed at portions of the front-side abutting plate not sandwiched at the outer end thereof by the bendable portions. In an exemplary heat retention material cartridge 35*a* illustrated in FIG. 23, a convex portion 302*c* extending in the longitudinal direction of the right-side portion of a front-side abutting plate 30*a* is formed at a portion not sandwiched at the outer end thereof by bendable portions 332*c*, of the right-side portion of the front-side abutting plate 30*a*. Further, a convex portion 302*d* extending in the longitudinal direction of the left-side portion of the front-side abutting plate 30*a* is formed at a portion not sandwiched at the outer end thereof by bendable portions 332*d*, of the left-side portion of the front-side abutting plate 30*a*.

Since the bendable portions at the right and left ends of the elastic member attached member are linearly bendable, they can be bent properly even when they are formed over the entire right or left end of the elastic member attached member in the up-and-down direction, like the embodied example illustrated in FIG. 6. Forming the bendable portions at the right and left ends of the elastic member attached member over the entire right or left end of the elastic member attached member in the up-and-down direction so as to sandwich the back-side pressing member, the thermosensitive expansion rubber, and the front-side abutting plate entirely at the right or left side thereof in the up-and-down direction is preferable in that cooling water can be prevented from strongly flowing from the right or left side of the heat retention material cartridge according to the first aspect of the present invention between the back-side pressing member and the front-side abutting plate.

The upper and lower ends of the heat retention material cartridge according to the first aspect of the present invention are arc-shaped when viewed from above. Therefore, if the bendable portions formed at the upper and lower ends of the elastic member attached member are excessively long in width, the bendable portions cannot be bent properly, and further the back-side pressing member, the thermosensitive expansion rubber, and the front-side abutting plate cannot be fixed properly. Therefore, the bendable portions formed at the upper and lower ends of the elastic member attached member can be appropriately selected in width, in a range in which normal bending is feasible and normal fixing of the back-side pressing member, the thermosensitive expansion rubber, and the front-side abutting plate is feasible. The number of the bendable portions formed at the upper and lower ends of the elastic member attached member is two or more in the circular arc direction of the heat retention material cartridge according to the first aspect of the present invention, when the heat retention material cartridge according to the present invention is viewed from above.

The bendable portions for fixing the heat retention material cartridge according to the present invention are formed at or near the center in the circular arc direction of the upper and lower ends of the elastic member attached member. The bendable portions formed at the upper and lower ends of the elastic member attached member can be appropriately selected in width, in a range in which normal bending is feasible and fixing to the support member is feasible.

Figure 22:
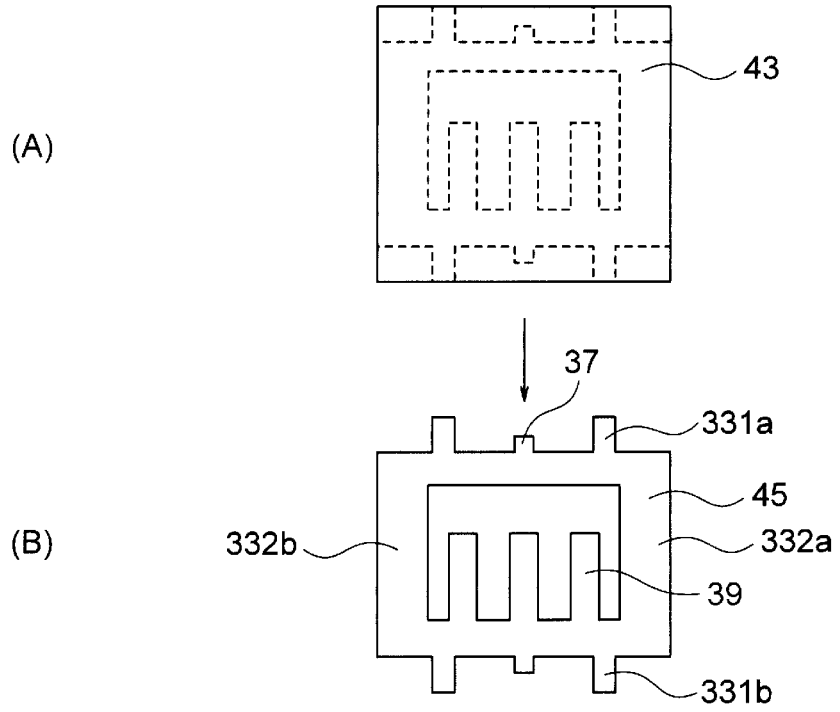
FIG. 22 is a schematic view illustrating a manufacturing procedure of an elastic member attached member.

As illustrated in FIG. 22, the manufacturing procedure of the elastic member attached member 33 includes preparing a metal plate 43, punching out the metal plate 43 along dotted lines indicated in FIG. 22(A) to form the metal plate spring 39, the bendable portions 331*a*, 331*b*, 332*a*, and 332*b*, and the bendable portions 37, as illustrated in FIG. 22(B), thereby manufacturing a metal plate punched product 45. Further, the manufacturing procedure includes forming the entire metal plate punched product 45 into an arc shape, and bending the metal plate spring 39 toward the back side to manufacture the elastic member attached member 33. In manufacturing the support member 34, a metal plate is shaped or a synthetic resin is injection-molded to obtain the support member 34.

The front-side abutting plate relating to the heat retention material cartridge according to the first aspect of the present invention is arc-shaped when viewed from above and has the substantially rectangular opening formed inside when viewed from the front side. In the heat retention material cartridge according to the first aspect of the present invention, the outer edge portion of the thermosensitive expansion rubber is sandwiched between the back-side pressing member and the front-side abutting plate so that the thermosensitive expansion rubber is fixed.

The front-side abutting plate has the portions sandwiched at the outer end thereof by the bendable portions, and the portions not sandwiched at the outer end thereof by the bendable portions. In the heat retention material cartridge, the front-side abutting plate has the portions not sandwiched at the outer end thereof by the bendable portions at least at the upper- and lower-side portions. Further, the heat retention material cartridge according to the first aspect of the present invention may include or not include the portions not sandwiched at the outer end thereof by the bendable portions at the right- and left-side portions of the front-side abutting plate. In other words, in the heat retention material cartridge according to the first aspect of the present invention, the right- and left-side portions of the front-side abutting plate may be entirely or partly sandwiched by the bendable portions at the outer end in the up-and-down direction.

The convex portions being convex toward the back-side pressing member are formed at the portions of the front-side abutting plate not sandwiched at the outer end thereof by the bendable portions. That is, the convex portions extending in the longitudinal direction of the upper-side portion of the front-side abutting plate are formed at the portions not sandwiched at the outer end thereof by the bendable portions, of the upper-side portion of the front-side abutting plate. The convex portions extending in the longitudinal direction of the lower-side portion of the front-side abutting plate are formed at the portions not sandwiched at the outer end thereof by the bendable portions, of the lower-side portion of the front-side abutting plate. Further, if there is any portion not sandwiched at the outer end thereof by the bendable portions in the right-side portion of the front-side abutting plate, the convex portion extending in the longitudinal direction of the right-side portion of the front-side abutting plate is formed in the right-side portion of the front abutting plate not sandwiched at the outer end thereof by the bendable portions. Further, if there is any portion not sandwiched at the outer end thereof by the bendable portions in the left-side portion of the front-side abutting plate, the convex portion extending in the longitudinal direction of the left-side portion of the front-side abutting plate is formed in the left-side portion of the front abutting plate not sandwiched at the outer end thereof by the bendable portions.

Further, in the heat retention material cartridge according to the first aspect of the present invention, at the portions of the front abutting plate where the convex portions are formed, the outer edge portion of the thermosensitive expansion rubber is formed so that the outer end of the thermosensitive expansion rubber is positioned inside the apex of the convex portion of the front abutting plate. In the portions of the front-side abutting plate where no convex portion is formed, namely, in the portions of the front-side abutting plate where the outer end is sandwiched by the bendable portions, it is preferable that the outer end of the thermosensitive expansion rubber is positioned inside the bendable portions.

The heat retention material cartridge according to a second aspect of the present invention is the heat retention material cartridge fixed to the base member of the heat retention tool of the cylinder bore's bore wall for heat retention of the cylinder bore wall, which includes the thermosensitive expansion rubber coming into contact with the cylinder bore-side wall surface of the groove-like cooling water passage and covering the cylinder bore-side wall surface of the groove-like cooling water passage, the back-side pressing member being arc-shaped when viewed from above, and provided on the back side of the thermosensitive expansion rubber for pressing the thermosensitive expansion rubber entirely from the back side toward the cylinder bore-side wall surface of the groove-like cooling water passage, the front-side abutting plate provided on the contact surface of the thermosensitive expansion rubber, having an arc-shape when viewed from above and having an rectangular opening when viewed from the front side, and cooperative with the back-side pressing member for sandwiching an outer edge portion of the thermosensitive expansion rubber, and the elastic member attached to the back-side pressing member for urging toward the cylinder bore-side wall surface of the groove-like cooling water passage, so that the back-side pressing member presses the thermosensitive expansion rubber, wherein the bendable portions are formed at the upper end, the lower end, the right end, and the left end of the back-side pressing, and the bendable portions are bent toward the front-side abutting plate, so that the thermosensitive expansion rubber and the front-side abutting plate are sandwiched between the bendable portions and the back-side pressing member, there is a portion where the outer end is not sandwiched by the bendable portions at least at the upper-side portion and the lower-side portion of the front-side abutting plate, a convex portion being convex toward the back-side pressing member and extending in the longitudinal direction of the upper-side portion of the front-side abutting plate is formed in the portion where the outer end is not sandwiched by the bendable portions at the upper-side portion of the front-side abutting plate, and a convex portion being convex toward the back-side pressing member and extending in the longitudinal direction of the lower-side portion of the front-side abutting plate is formed in the portion where the outer end is not sandwiched by the bendable portions at the lower-side portion of the front-side abutting plate, and the outer edge portion of the thermosensitive expansion rubber is formed in such a manner that the outer end of the thermosensitive expansion rubber is positioned inside the apex of the convex portion, at the portion of the front-side abutting plate where the convex portion is formed.

The heat retention material cartridge according to the second aspect of the present invention and the heat retention material cartridge according to the first aspect of the present invention are mainly different in that the elastic member attached member is provided in the heat retention material cartridge according to the first aspect of the present invention and the elastic member is attached to the elastic member attached member, meanwhile the elastic member attached member is not provided in the heat retention material cartridge according to the second aspect of the present invention and the elastic member is attached to the back-side pressing member. Therefore, regarding points common to the heat retention material cartridge according to the second aspect of the present invention and the heat retention material cartridge according to the first aspect of the present invention, the description of the heat retention material cartridge according to the first aspect of the present invention will be referred to and detailed description will be omitted.

The heat retention material cartridge according to the second aspect of the present invention is the heat retention material cartridge fixed to the base member of the cylinder bore wall heat retention tool for heat retention of the cylinder bore wall. The heat retention material cartridge according to the second aspect of the present invention has the back-side pressing member to which the elastic member is attached and being arc-shaped when viewed from above, the thermosensitive expansion rubber thermo-sensitively expanding in the groove-like cooling water passage, having the contact surface coming into contact with the cylinder bore wall of the groove-like cooling water passage, and covering the cylinder bore wall, and the front-side abutting plate being arc-shaped when viewed from above, which are sequentially overlapped. The bendable portions formed at the upper end of the back-side pressing member, the bendable portions formed at the lower end of the back-side pressing member, the bendable portion formed at the right end of the back-side pressing member, and the bendable portion formed at the left end of the back-side pressing member are bent toward the front-side abutting plate, so that the thermosensitive expansion rubber and the front-side abutting plate are sandwiched between the bendable portions and the back-side pressing member, thereby fixing these members to the back-side pressing member.

The heat retention material cartridge according to the second aspect of the present invention is fixed to each bore portion of the support member formed into the shape along the groove-like cooling water passage in which the cylinder bore wall heat retention tool is installed, that is, the shape including plural arcs that are continuous when viewed from above. In fixing the heat retention material cartridge according to the second aspect of the present invention to the support member, the bendable portions formed at the upper and lower ends of the back-side pressing member are bent toward the support member, and the support member is sandwiched between the bendable portions and the back-side pressing member. As a result, the heat retention material cartridge according to the second aspect of the present invention is fixed to the support member.

The thermosensitive expansion rubber relating to the heat retention material cartridge according to the second aspect of the present invention is similar to the heat retention material cartridge according to the first aspect of the present invention.

The back-side pressing member relating to the heat retention material cartridge according to the first aspect of the present invention is arc-shaped when viewed from above, has the shape along the back side of the thermosensitive expansion rubber (the surface on the side opposite to the contact surface side) so that entire thermosensitive expansion rubber can be pressed from the back side of the thermosensitive expansion rubber, and has the shape covering the entire back side or substantially the entire back side of the thermosensitive expansion rubber. The material of the back-side pressing member can be appropriately selected if it can deform in such a way as to press the thermosensitive expansion rubber toward the cylinder bore-side wall surface of the groove-like cooling water passage when pushed from the back side by the elastic member. Metal plates of stainless steel, aluminum alloy, and the like are preferable. The thickness of the back-side pressing member can be appropriately selected if it can deform in such a way as to press the rubber member toward the cylinder bore-side wall surface of the groove-like cooling water passage when pressed from the back side by the elastic member.

Further, the elastic member is attached to the back-side pressing member relating to the heat retention material cartridge according to the second aspect of the present invention. Further, the bendable portions are formed at the upper, lower, right, and left ends of the back-side pressing member relating to the heat retention material cartridge according to the second aspect of the present invention. The elastic member is the elastic urging member that enables the back-side pressing member to press the thermosensitive expansion rubber toward the cylinder bore-side wall surface of the groove-like cooling water passage, when the cylinder bore wall heat retention tool fixed to the heat retention material cartridge according to the second aspect of the present invention is installed in the groove-like cooling water passage, and the thermosensitive expansion rubber expands and elastically deforms.

When the heat retention material cartridge according to the second aspect of the present invention is viewed from above, two or more elastic members are attached in the circular arc direction of the heat retention material cartridge according to the second aspect of the present invention. In the case where the attachment place for the elastic member is only one, the elastic member is attached to the heat retention material cartridge according to the second aspect of the present invention at or near the center in the circular arc direction in order to press the heat retention tool entirely.

However, in this case, since the heat retention material cartridge according to the second aspect of the present invention is fixed to the support member at or near the center, the heat retention material cartridge according to the second aspect of the present invention is pressed together with the support member. Therefore, in the heat retention material cartridge according to the second aspect of the present invention, independently of the support member, the portion adjacent to the edge of the heat retention material cartridge according to the second aspect of the present invention is not separated from the support member and does not deform in such a way as to press the thermosensitive expansion rubber toward the cylinder bore-side wall surface of the groove-like cooling water passage. Because of this, the elastic members need to be attached at least at two places in total, at one place near one end at the other place near the other end, of the heat retention material cartridge according to the second aspect of the present invention, so that the portions adjacent to both edges of the heat retention material cartridge according to the second aspect of the present invention are separated from the support member and deform in such a way as to press the thermosensitive expansion rubber toward the cylinder bore-side wall surface of the groove-like cooling water passage, independently of the support member. Further, it is preferable that the elastic members are attached at three positions in total, at one place at or near the center in the circular arc direction of the heat retention material cartridge according to the second aspect of the present invention, at one place near one end and at another place near the other end of the heat retention material cartridge according to the second aspect of the present invention, so that the heat retention material cartridge according to the second aspect of the present invention is entirely pressed and the portions adjacent to both edges of the heat retention material cartridge according to the second aspect of the present invention are pressed independently of the support member. Further, to enhance the adhesion of the thermosensitive expansion rubber of the heat retention material cartridge according to the first aspect of the present invention to the cylinder bore-side wall surface of the groove-like cooling water passage, the elastic members can be attached at four portions or more in the circular arc direction.

The elastic member relating to the heat retention material cartridge according to the second aspect of the present invention is similar to the elastic member relating to the heat retention material cartridge according to the first aspect of the present invention, although the member to which the elastic member is attached is different.

Among the bendable portions formed on the back-side pressing member, the bendable portions formed at the right and left ends can be formed over the whole of the up-and-down direction at the right end or the left end of the back-side pressing member, or can be formed partly at the right end or the left end of the back-side pressing member in the up-and-down direction. In the case where the bendable portions are partly formed at the right end or the left end of the back-side pressing member, convex portions are formed at portions of the front-side abutting plate not sandwiched at the outer end thereof by the bendable portions. Since the bendable portions at the right and left ends of the back-side pressing member are linearly bendable, they can be bent properly even when they are formed over the whole of the up-and-down direction at the right end or the left end of the back-side pressing member. Forming the bendable portions over the whole of the up-and-down direction at the right end or the left end of the back-side pressing member so as to sandwich the thermosensitive expansion rubber and the front-side abutting plate at the right or left side thereof in the up-and-down direction is preferable in that cooling water can be prevented from strongly flowing from the right or left side of the heat retention material cartridge according to the second aspect of the present invention between the back-side pressing member and the front-side abutting plate.

The upper and lower ends of the heat retention material cartridge according to the second aspect of the present invention are arc shaped when viewed from above. Therefore, if the bendable portions formed at the upper and lower ends of the back-side pressing member are excessively long in width, the bendable portions cannot be bent properly, and further the thermosensitive expansion rubber and the front-side abutting plate cannot be fixed properly. Therefore, the bendable portions formed at the upper and lower ends of the back-side pressing member can be appropriately selected in width, in a range in which normal bending is feasible and normal fixing of the thermosensitive expansion rubber and the front-side abutting plate is feasible. The number of the bendable portions formed at the upper and lower ends of the back-side pressing member is two or more in the circular arc direction of the heat retention material cartridge according to the second aspect of the present invention, when the heat retention material cartridge according to the second aspect of the present invention is viewed from above.

The bendable portions for fixing the heat retention material cartridge according to the second aspect of the present invention are formed at or near the center of the upper and lower ends of the back-side pressing member. The bendable portions formed at the upper and lower ends of the back-side pressing member can be appropriately selected in width, in a range in which normal bending is feasible and fixing to the support member is feasible.

Figure 24:
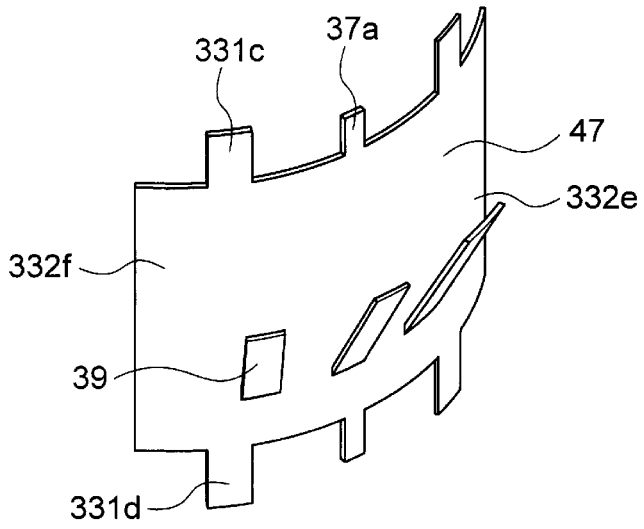
FIG. 24 is a schematic perspective view illustrating a back-side pressing member to which an elastic member is attached.
Figure 25:
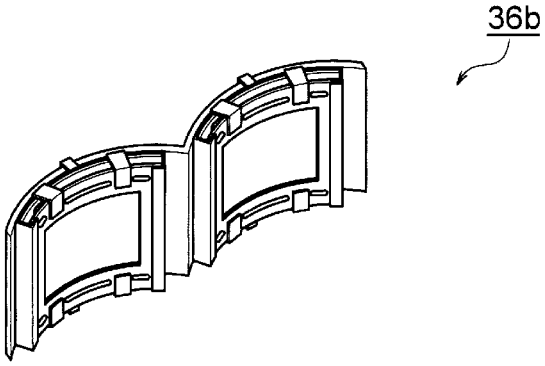
FIG. 25 is a schematic perspective view illustrating an embodied example of the cylinder bore wall heat retention tool according to the present invention.
Figure 25:
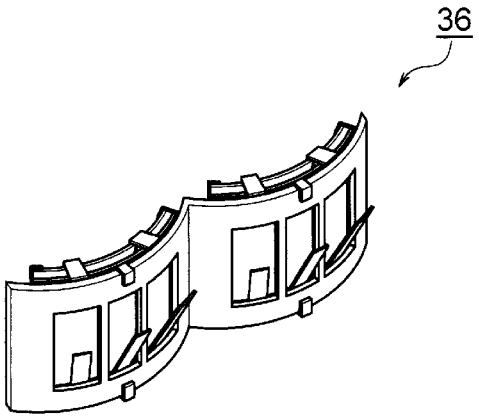
Figure 26:
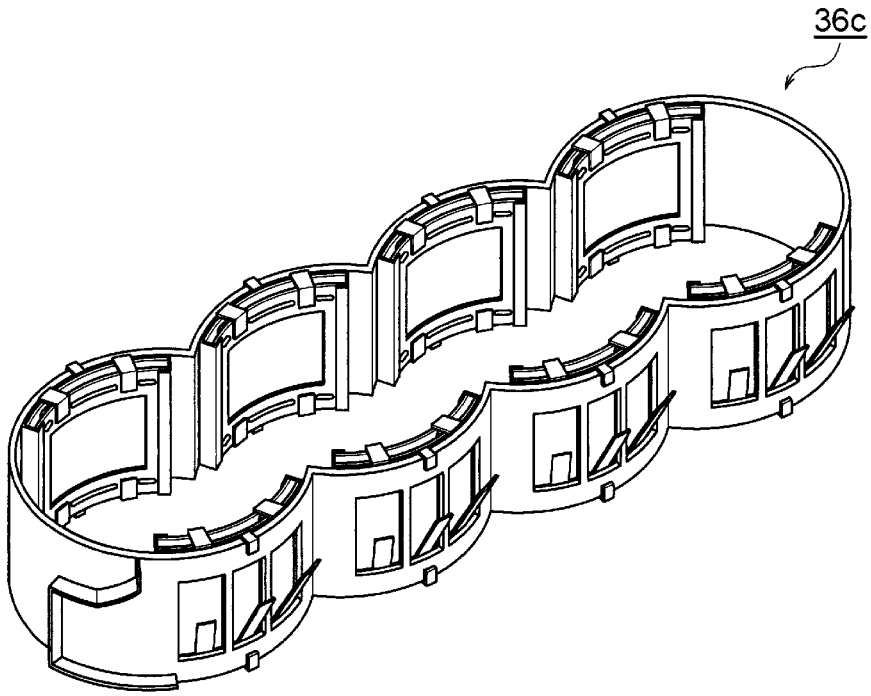
FIG. 26 is a schematic perspective view illustrating an embodied example of the cylinder bore wall heat retention tool according to the present invention.
Figure 27:
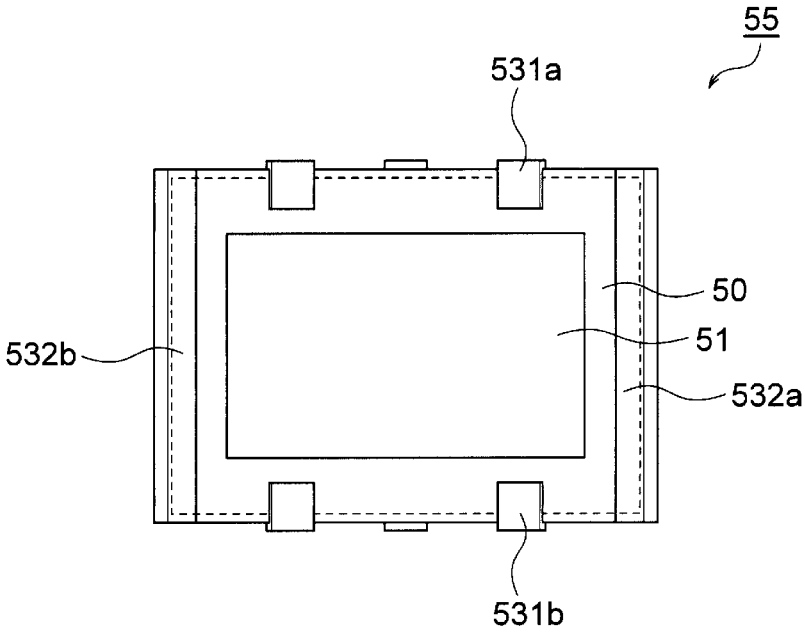
FIG. 27 is a schematic front view illustrating a conventional heat retention material cartridge.

As the back-side pressing member to which the elastic member is attached, for example, an embodied example illustrated in FIG. 24 may be employed. In the embodied example illustrated in FIG. 24, the metal plate spring 39 made of a longitudinally long rectangular metal plate is welded to a back pressing member 47 made of a metal plate and having bendable portions 331*c*, 331*d*, 332*e*, and 332*f* formed at the upper, lower, right, and left ends thereof. Further, instead of using the metal plate spring, for example, another embodied example using a metal elastic member such as a metal coil spring, a leaf spring, or a torsion spring welded to the back pressing member made of a metal plate and having bendable portions formed at the upper, lower, right, and left ends thereof may be employed.

The front-side abutting plate relating to the heat retention material cartridge according to the second aspect of the present invention is similar to the front-side abutting plate relating to the heat retention material cartridge according to the first aspect of the present invention.

Further, in the heat retention material cartridge according to the second aspect of the present invention, the outer edge portion of the thermosensitive expansion rubber is formed in such a manner that the outer end of the thermosensitive expansion rubber is positioned inside the apex of the convex portion of the front abutting plate, at the portion of the front abutting plate where the convex portion is formed.

The cylinder bore wall heat retention tool according to the present invention is the heat retention tool installed in the groove-like cooling water passage of the cylinder block of an internal combustion engine having cylinder bores for heat retention of bore walls of the cylinder bores, having the heat retention material cartridge according to the present invention, and the metal-made or synthetic resin-made support member having the shape along the shape of the groove-like cooling water passage at the installation position of the heat retention tool, to which the heat retention material cartridge is fixed, wherein the heat retention material cartridge is fixed to the support member only at or near the center in the circular arc direction. The heat retention material cartridge according to the first aspect of the present invention and the heat retention material cartridge according to the second aspect of the present invention are collectively referred to as the heat retention material cartridge according to the present invention.

The support member is formed in the shape in which plural arcs are continuous when viewed from above, and the shape of the support member is the shape along one side half of the groove-like cooling water passage. Further, the support member has the opening so that the elastic member attached to the heat retention material cartridge according to the present invention can pass through the support member, from the back side of the cylinder bore wall heat retention tool according to the present invention, and protrude toward the wall surface on the side opposite to the cylinder bore-side wall surface of the groove-like cooling water passage.

The support member is the member to which the heat retention material cartridge according to the present invention is fixed, and plays a role in determining the position of the heat retention material cartridge according to the present invention so that the position of the heat retention material cartridge according to the present invention does not shift in the groove-like cooling water passage. The support member is a metal plate or a molded body of a synthetic resin.

Then, in the cylinder bore wall heat retention tool according to the present invention, the heat retention material cartridge according to the present invention is fixed to the support member only at or near the center in the circular arc direction when viewed from above (at or near the center of the arc-shaped heat retention material cartridge according to the present invention when the heat retention material cartridge according to the present invention is viewed from above). On the other hand, the portion adjacent to the edge of the heat retention material cartridge according to the present invention is not fixed to the support member.

After the cylinder bore wall heat retention tool according to the present invention is installed in the groove-like cooling water passage of the cylinder block, when the internal combustion engine is driven, the thermosensitive expansion rubber is heated and thermo-sensitively expands. Then, the thermosensitive expansion rubber expands toward the cylinder bore-side wall surface through the opening formed in the inner portion of the front-side abutting plate, and the contact surface comes into contact with the cylinder bore wall surface. Even after the contact surface has contacted the cylinder bore-side wall surface, the thermosensitive expansion rubber continues to expand until it reaches an opened state. Therefore, the elastic member is subjected to the force directing toward the back side of the heat retention material cartridge according to the present invention. As a result, the elastic member deforms and the elastic member generates the elastic force for returning to the original position. Then, by this elastic force, the elastic member attached member to which the elastic member is attached or the back-side pressing member to which the attachment member is attached is pushed toward the cylinder bore-side wall surface of the groove-like cooling water passage. As a result, the back-side pressing member pushes the thermal expansion rubber, the thermosensitive expansion rubber is pressed against the cylinder bore-side wall surface of the groove-like cooling water passage. That is, when the cylinder bore wall heat retention tool according to the present invention is installed in the groove-like cooling water passage and the thermosensitive expansion rubber is heated and thermo-sensitively expands, the elastic member deforms and the elastic force generated to restore from the deformation urges the back-side pressing member in such a way as to press the thermosensitive expansion rubber against the cylinder bore-side wall surface of the groove-like cooling water passage. Thus, the thermosensitive expansion rubber of the heat retention material cartridge according to the present invention comes into contact with the bore wall surfaces of the respective cylinder bores of the cylinder bore-side wall surface of the groove-like cooling water passage.

In the cylinder bore wall heat retention tool according to the present invention, the heat retention material cartridge according to the present invention is fixed to the support member only at or near the center in the circular arc direction when the heat retention material cartridge according to the present invention is viewed from above, when the elastic member urges the elastic member attached member or the back-side pressing member of the heat retention material cartridge according to the present invention, the elastic member attached member (only in the case of the first heat retention material cartridge according to the present invention, the same applies hereinafter), the back-side pressing member, the thermosensitive expansion rubber, and the front-side abutting plate can deform independently of the support member. In the manufacturing of the cylinder bore wall heat retention tool according to the present invention, the elastic member attached member, the back-side pressing member, the thermosensitive expansion rubber, and the front-side abutting plate are processed so that their curvatures match the curvatures of the wall surfaces of the bore walls of the respective cylinder bores with which the thermosensitive expansion rubber comes into contact. However, in fact, processing errors occur with respect to design values in any of the elastic member attached member, the back-side pressing member, the thermosensitive expansion rubber, the front-side abutting plate, and the wall surfaces of the bore walls of the respective cylinder bores. Then, when the curvatures of the elastic member attached member, the back-side pressing member, the thermosensitive expansion rubber, and the front-side abutting plate become smaller than the curvatures of the wall surfaces of the bore walls of the respective cylinder bores due to processing errors of these members or the wall surfaces of the bore walls of the respective cylinder bores, if the heat retention material cartridge is entirely fixed to the support portion (for example, fixed to the support member at a total of three positions near the center and both ends in the circular arc direction when the heat retention portion is viewed from above), the thermosensitive expansion rubber can come into contact with the bore walls of the respective cylinder bores at the portion near the center in the circular arc direction but cannot contact the bore walls at the portion adjacent to the edge, when urged by the elastic member. On the other hand, when the curvatures of the elastic member attached member, the back-side pressing member, the thermosensitive expansion rubber, and the front-side abutting plate become smaller than the curvatures of the wall surfaces of the bore walls of the respective cylinder bores, if the heat retention material cartridge according to the present invention is fixed to the support member only at or near the center in the circular arc direction when the heat retention material cartridge is viewed from above, the portion adjacent to the edge of the heat retention material cartridge according to the present invention is separated from the support member and can deform toward the bore walls of the respective cylinder bores when urged by the elastic member. Therefore, the thermosensitive expansion rubber can come into contact with the bore walls of the respective cylinder bores not only at the portion near the center but also at the portion adjacent to the edge in the circular arc direction. Because of this, in the cylinder bore wall heat retention tool according to the present invention, even if the curvatures of the elastic member attached member, the back-side pressing member, the thermosensitive expansion rubber, and the front-side abutting plate are different from the curvatures of the wall surfaces of the bore walls of the respective cylinder bores due to processing errors, the thermosensitive expansion rubber can be surely brought into contact with the wall surfaces of the bore walls of respective cylinder bores. Therefore, the adhesion of the thermosensitive expansion rubber to the wall surfaces of the bore walls of the respective cylinder bores (the cylinder bore-side wall surface of the groove-like cooling water passage) is enhanced.

Further, when the curvatures of the elastic member attached member, the back-side pressing member, the thermosensitive expansion rubber, and the front-side abutting plate are larger than the curvatures of the bore walls of respective cylinder bores, if the heat retention material cartridge is entirely fixed to the support member, the curvatures of the elastic member attached member, the back-side pressing member, the thermosensitive expansion rubber, and the front-side abutting plate do not change. Therefore, there is a possibility that a gap may be formed between the thermosensitive expansion rubber and the bore walls in the vicinity of the center in the circular arc direction when viewed from above. On the other hand, in the cylinder bore wall heat retention tool according to the present invention, even if the curvatures of the elastic member attached member, the back-side pressing member, the thermosensitive expansion rubber, and the front-side abutting plate are larger than the curvatures of the bore walls of respective cylinder bores, since the heat retention material cartridge according to the present invention is fixed to the support member only at or near the center in the circular arc direction, the heat retention material cartridge according to the present invention is pushed by the elastic member from the back side at or near the center in the circular arc direction, and the portions of the heat retention material cartridge according to the present invention other than the center or portions near the center in the circular arc direction deform in such a manner that the heat retention material cartridge according to the present invention opens outward at the portions adjacent to both ends in the circular arc direction, independently of the support member. Therefore, the thermosensitive expansion rubber can come into contact with the bore walls of the respective cylinder bores not only at the portion near the center but also the portion adjacent to the edge in the circular arc direction. Because of this, in the cylinder bore wall heat retention tool according to the present invention, even if the curvatures of the elastic member attached member, the back-side pressing member, the thermosensitive expansion rubber, and the front-side abutting plate are different from the curvatures of the wall surfaces of the bore walls of the respective cylinder bores due to processing errors, the thermosensitive expansion rubber can be surely brought into contact with the wall surfaces of the bore walls of the respective cylinder bores. Therefore, the adhesion of the thermosensitive expansion rubber to the wall surfaces of the bore walls of the respective cylinder bores (the cylinder bore-side wall surface of the groove-like cooling water passage) is enhanced.

In the heat retention material cartridge according to the present invention, the bendable portions are present in such a way as to cover the outer end of the thermosensitive expansion rubber in the portions of the front-side abutting plate sandwiched by the bendable portions. Therefore, even when the thermosensitive expansion rubber expands, the outer edge portion of the thermosensitive expansion rubber does not protrude from the heat retention material cartridge according to the present invention. Further, since the bendable portions are present in such a way as to cover the outer end of the thermosensitive expansion rubber, it is insensitive to the flow of cooling water. Therefore, the problem of breakage of the thermosensitive expansion rubber by the cooling water does not occur.

In the heat retention material cartridge according to the present invention, in the portions of the front-side abutting plate not sandwiched by the bendable portions, the convex portions extending in the longitudinal direction of the front-side abutting plate are present in such a way as to protrude toward the back-side pressing member at the outer positions than the outer end of thermosensitive expansion rubber. Therefore, even when the thermosensitive expansion rubber expands, the outer edge portion of the thermosensitive expansion rubber cannot easily protrude from the heat retention material cartridge according to the present invention. Further, since the convex portions are present at the outer positions as compared with the outer end of the thermosensitive expansion rubber, the flow velocity of the cooling water flowing toward the outer end of the thermosensitive expansion rubber becomes very slow due to the presence of the convex portions even when the cooling water flows into the gap between the back-side pressing member and the front-side abutting plate. Therefore, the problem of breakage of the thermosensitive expansion rubber by the cooling water does not occur.

The internal combustion engine according to the present invention is an internal combustion engine in which the cylinder bore wall heat retention tool according to the present invention is installed.

An automotive vehicle according to the present invention is an automotive vehicle having the internal combustion engine according to the present invention.

REFERENCE SIGNS LIST

8 lowermost portion
9 uppermost portion
10 intermediate position
11 cylinder block
12 bore
**12*a*1, 12*a*2** end bore
**12*b*1, 12*b*2** intermediate bore
13 cylinder bore wall
14 groove-like cooling water passage
15 cooling water supply port
16 cooling water discharge port
17 cylinder bore-side wall surface of groove-like cooling water passage 14
**17*a*, 17*b*** one side half wall surface
18 wall surface on side opposite to cylinder bore-side wall surface of groove-like cooling water passage 14
**21*a*, 21*b*** one side half bore wall
**23*a*1, 23*a*2, 23*b*1, 23*b*2** bore walls of respective cylinder bores
26 contact surface

27 tip end
30 front-side abutting plate
31 thermosensitive expansion rubber
32 back-side pressing member
33 elastic member attached member
34 support member
35, 35*a* heat retention material cartridge
36, 36*b*, 36*c* cylinder bore wall heat retention tool
37, 37*a*, 331*a*, 331*b*, 331*c*, 331*d*, 332*a*, 332*b*, 332*c*, 332*d*, 332*e*, 332*f* bendable portion
38 cooling water flow partition member
39 metal plate spring
42 opening
43 metal plate
45 metal plate punched product
191 inter-bore portion
192 boundary of bore walls of respective cylinder bores of cylinder bore-side wall surface of groove-like cooling water passage
301 opening
302, 302*a*, 302*b*, 302*c*, 302*d* convex portion
303, 303*a*, 303*b*, 303*c*, 303*d* portion of front-side abutting plate sandwiched at outer end thereof by bendable portion
304, 304*a*, 304*b* portion of front-side abutting plate not sandwiched at outer end thereof by bendable portion
308*a* upper-side portion of front-side abutting plate
308*b* lower-side portion of front-side abutting plate
311 contour of thermosensitive expansion rubber
312*a*, 312*b*, 313*a*, 313*b*, 313*c*, 313*d* outer end of thermosensitive expansion rubber
319 cutout portion

The invention claimed is:

1. A heat retention material cartridge fixed to a base member of a heat retention tool of a cylinder bore's bore wall for heat retention of the cylinder bore wall, comprising:

a thermosensitive expansion rubber coming into contact with a cylinder bore-side wall surface of a groove-like cooling water passage and covering the cylinder bore-side wall surface of the groove-like cooling water passage;

a back-side pressing member being arc-shaped when viewed from above, and provided on a back side of the thermosensitive expansion rubber for pressing the thermosensitive expansion rubber entirely from the back side toward the cylinder bore-side wall surface of the groove-like cooling water passage;

a front-side abutting plate provided on a contact surface of the thermosensitive expansion rubber, having an arc-shape when viewed from above and having an rectangular opening when viewed from the front side and cooperative with the back-side pressing member for sandwiching an outer edge portion of the thermosensitive expansion rubber; and an elastic member attached member to which an elastic member is attached, being arc-shaped when viewed from above, and provided on a back side of the back-side pressing member for urging toward the cylinder bore-side wall surface of the groove-like cooling water passage so that the back-side pressing member presses the thermosensitive expansion rubber, wherein bendable portions are formed at an upper end, a lower end, a right end, and a left end of the elastic member attached member, and the bendable portions are bent toward the front-side abutting plate, so that the back-side pressing member, the thermosensitive expansion rubber, and the front-side abutting plate are sandwiched between the bendable portion and the elastic member attached member, there is a portion where the outer end is not sandwiched by the bendable portions at least at an upper-side portion and a lower-side portion of the front-side abutting plate, a convex portion being convex toward the back-side pressing member and extending in a longitudinal direction of the upper-side portion of the front-side abutting plate is formed in the portion where the outer end is not sandwiched by the bendable portions at the upper-side portion of the front-side abutting plate, and a convex portion being convex toward the back-side pressing member and extending in the longitudinal direction of the lower-side portion of the front-side abutting plate is formed in the portion where the outer end is not sandwiched by the bendable portions at the lower-side portion of the front-side abutting plate, and the outer edge portion of the thermosensitive expansion rubber is formed in such a manner that the outer end of the thermosensitive expansion rubber is positioned inside an apex of the convex portion, at the portion of the front-side abutting plate where the convex portion is formed.

2. A heat retention material cartridge fixed to a base member of a heat retention tool of a cylinder bore's bore wall for heat retention of the cylinder bore wall, comprising:

a thermosensitive expansion rubber coming into contact with a cylinder bore-side wall surface of a groove-like cooling water passage and covering the cylinder bore-side wall surface of the groove-like cooling water passage;

a back-side pressing member being arc-shaped when viewed from above, and provided on a back side of the thermosensitive expansion rubber for pressing the thermosensitive expansion rubber entirely from the back side toward the cylinder bore-side wall surface of the groove-like cooling water passage;

a front-side abutting plate provided on a contact surface of the thermosensitive expansion rubber, having an arc-shape when viewed from above and having an rectangular opening when viewed from the front side, and cooperative with the back-side pressing member for sandwiching an outer edge portion of the thermosensitive expansion rubber; and an elastic member attached to the back-side pressing member for urging toward the cylinder bore-side wall surface of the groove-like cooling water passage so that the back-side pressing member presses the thermosensitive expansion rubber, wherein bendable portions are formed at an upper end, a lower end, a right end, and a left end of the back-side pressing, and the bendable portions are bent toward the front-side abutting plate, so that the thermosensitive expansion rubber and the front-side abutting plate are sandwiched between the bendable portions and the back-side pressing member, there is a portion where the outer end is not sandwiched by the bendable portions at least at an upper-side portion and a lower-side portion of the front-side abutting plate, a convex portion being convex toward the back-side pressing member and extending in the longitudinal direction of the upper-side portion of the front-side abutting plate is formed in the portion where the outer end is not sandwiched by the bendable portions at the upper-side portion of the front-side abutting plate, and a convex portion being convex toward the back-side pressing member and extending in the longitudinal direction of the lower-side portion of the front-side abutting plate is formed in the portion where the outer end is not sandwiched by the bendable portions at the lower-side portion of the front-side abutting plate, and the outer edge portion of the thermosensitive expansion rubber is formed in such a manner that the outer end of the thermosensitive expansion rubber is positioned inside an apex of the convex portion, at the portion of the front-side abutting plate where the convex portion is formed.

* * * * *